US012467655B2

(12) United States Patent
Yamamoto et al.

(10) Patent No.: US 12,467,655 B2
(45) Date of Patent: Nov. 11, 2025

(54) INDOOR UNIT

(71) Applicant: DAIKIN INDUSTRIES, LTD., Osaka (JP)

(72) Inventors: Ryosuke Yamamoto, Osaka (JP); Yohei Koyama, Osaka (JP); Youta Katou, Osaka (JP); Kazuaki Ando, Osaka (JP); Taiki Kogawa, Osaka (JP); Shin Higashiyama, Osaka (JP); Kosuke Hotta, Osaka (JP); Shinichi Ishizeki, Osaka (JP); Toshiaki Kumata, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 175 days.

(21) Appl. No.: 18/524,976

(22) Filed: Nov. 30, 2023

(65) Prior Publication Data

US 2024/0102688 A1 Mar. 28, 2024

Related U.S. Application Data

(63) Continuation of application No. PCT/JP2022/022037, filed on May 31, 2022.

(30) Foreign Application Priority Data

Jun. 2, 2021 (JP) ..... 2021-092679

(51) Int. Cl.
*F24F 11/88* (2018.01)

(52) U.S. Cl.
CPC ..... *F24F 11/88* (2018.01)

(58) Field of Classification Search
CPC ..... H04B 3/54
See application file for complete search history.

(56) References Cited

FOREIGN PATENT DOCUMENTS

EP 3680566 A1 * 7/2020 ..... F24F 11/88
JP 7-63402 A 3/1995

(Continued)

OTHER PUBLICATIONS

International Search Report for PCT/JP2022/022037 (PCT/ISA/210) mailed on Aug. 2, 2022.

(Continued)

*Primary Examiner* — Emmanuel E Duke
(74) *Attorney, Agent, or Firm* — Birch, Stewart, Kolasch & Birch, LLP

(57) ABSTRACT

An indoor unit included in an air conditioner that includes an outdoor unit includes a power receiving circuit (PR2), a low-frequency transmission and reception circuit as a first reception circuit, a high-frequency transmission and reception circuit as a transmission and reception circuit, and an inner-controller. The low-frequency transmission and reception circuit receives a current signal transmitted from an outdoor unit by using a current loop formed by a power line included in power supply wiring. For a first communication state in which physical connection between with the outdoor unit is recognized and a second communication state in which communication for operation of the air conditioner is performed between with the outdoor unit, the inner-controller selects use of the low-frequency transmission and reception circuit and the high-frequency transmission and reception circuit in the first communication state and the second communication state.

13 Claims, 11 Drawing Sheets

(56) References Cited

FOREIGN PATENT DOCUMENTS

| | | | | | |
|---|---|---|---|---|---|
| JP | H0763402 | B2 | * | 7/1995 | |
| JP | 2010183341 | A | * | 8/2010 | |
| JP | 2013137119 | A | * | 7/2013 | |
| JP | 2017-9204 | A | | 1/2017 | |
| JP | 2017009204 | A | * | 1/2017 | |
| JP | 2019140758 | A | * | 8/2019 | |
| WO | WO-2019049330 | A1 | * | 3/2019 | ..... F24F 11/65 |
| WO | WO 2019/064401 | A1 | | 4/2019 | |

OTHER PUBLICATIONS

Extended European Search Report for European Application No. 22816077.6, dated Jul. 29, 2024.

International Preliminary Report on Patentability and English translation of the Written Opinion of the International Searching Authority for International Application No. PCT/JP2022/022037, dated Dec. 14, 2023.

* cited by examiner

INDOOR UNIT

CROSS REFERENCE TO RELATED APPLICATIONS

This application is a Continuation of PCT International Application No. PCT/JP2022/022037, filed on May 31, 2022, which claims priority under 35 U.S.C. § 119(a) to Patent Application No. JP 2021-092679, filed in Japan on Jun. 2, 2021, all of which are hereby expressly incorporated by reference into the present application.

TECHNICAL FIELD

The present invention relates to an indoor unit included in an air conditioner including an outdoor unit.

BACKGROUND ART

Conventionally, for example, as described in Patent Literature 1 (JP 2013-137119 A), there is a case where communication is performed in an air conditioner, through wiring for connecting an outdoor unit and an indoor unit to supply electric power. For example, a multi-type air conditioner for store use and a residential air conditioner can be easily configured to directly connect an outdoor unit and an indoor unit with wiring for electric power supply, since the number of indoor units connected to one outdoor unit is small. Therefore, a multi-type air conditioner for store use and a residential air conditioner may be configured to directly connect the outdoor unit and the indoor unit with wiring for electric power supply.

SUMMARY

An indoor unit according to one aspect is an indoor unit included in an air conditioner including an outdoor unit. The indoor unit includes a power receiving circuit, a first reception circuit, a transmission and reception circuit, and a inner-controller. The power receiving circuit can be connected to the outdoor unit by power supply wiring to receive electric power via the outdoor unit, and can be connected except for the outdoor unit to receive electric power. The first reception circuit can receive a current signal transmitted from the outdoor unit by using a current loop configured by a power line included in the power supply wiring. The transmission and reception circuit can transmit and receive a voltage signal for communication using a change in voltage. Regarding a first communication state in which physical connection between with the outdoor unit is recognized and a second communication state in which communication for operation of the air conditioner is performed between with the outdoor unit, the inner-controller selects use of the transmission and reception circuit and the first reception circuit in the first communication state and the second communication state.

Figure 1:
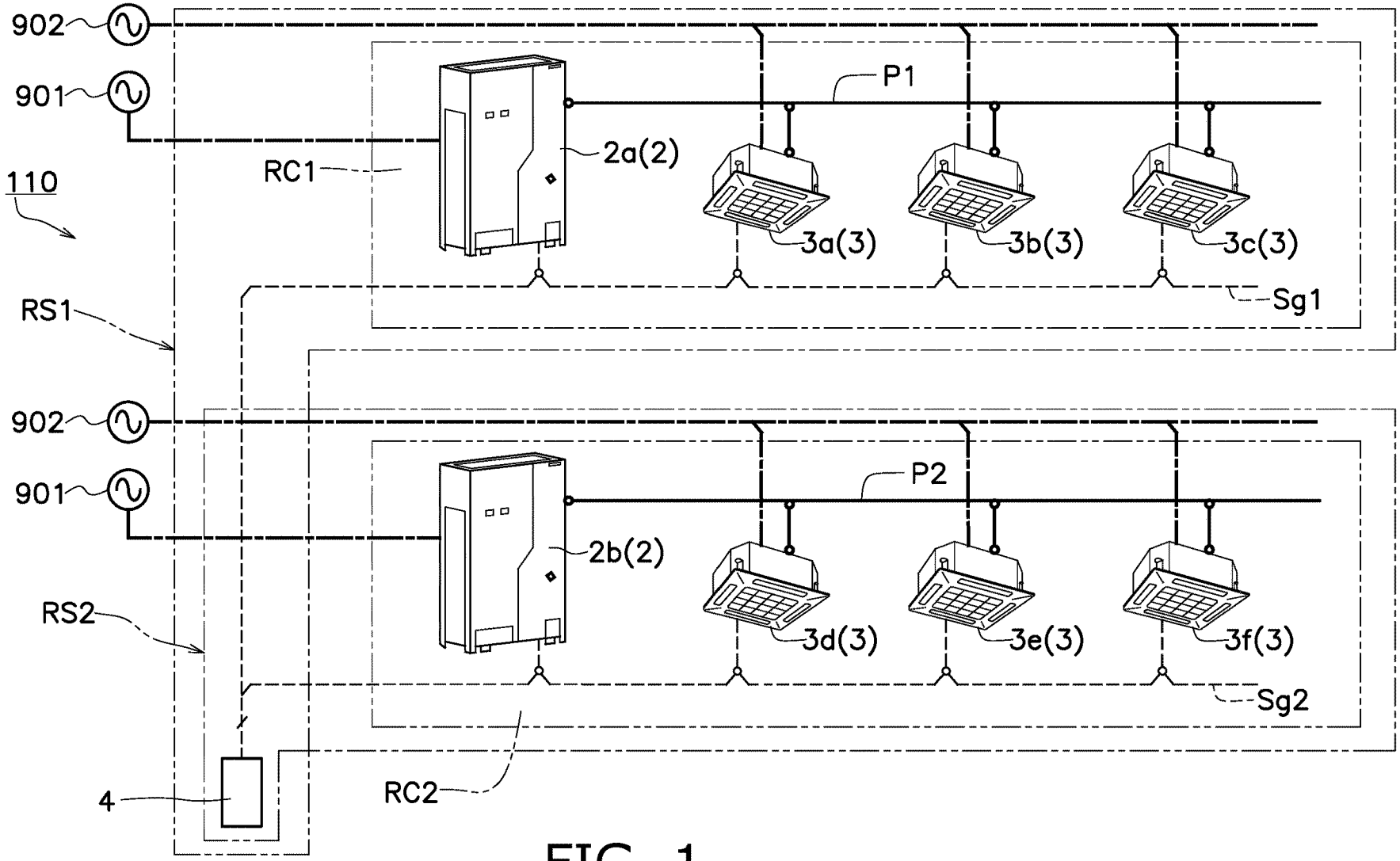
FIG. 1 is a schematic diagram illustrating an example of a configuration of a multi-split air conditioner.

DESCRIPTION OF EMBODIMENTS (1) Configuration of Air Conditioner (1-1) Multi-Split Air Conditioner for Building Use An air conditioner 110 illustrated in FIG. 1 includes a plurality of outdoor units 2, a plurality of indoor units 3, and a centralized-controller 4. In this air conditioner 110, the plurality of outdoor units 2, the plurality of indoor units 3, and the centralized-controller 4 are connected so as to be able to communicate with each other, to perform air conditioning of a target space. Although not illustrated in FIG. 1, the plurality of outdoor units 2 and the plurality of indoor units 3 include, for example, a heat exchanger for air conditioning. Here, a case where the air conditioner 110 includes the centralized-controller 4 will be described, but the air conditioner 110 may not include the centralized-controller 4.

The air conditioner 110 is of a multi-split type for building use. In the multi-split air conditioner 110, the outdoor unit 2 is connected to a commercial power source 901 for electric power supply to the outdoor unit 2, and the indoor unit 3 is connected to a commercial power source 902 for electric power supply to the indoor unit 3. As described above, in the multi-split air conditioner 110, the commercial power source 901 for driving the outdoor unit 2 and the commercial power source 902 for driving the indoor unit 3 are separate systems.

The plurality of outdoor units 2 include a first outdoor unit 2*a* and a second outdoor unit 2*b*. The plurality of indoor units 3 include a first indoor unit 3*a*, a second indoor unit 3*b*, a third indoor unit 3*c*, a fourth indoor unit 3*d*, a fifth indoor unit 3*e*, and a sixth indoor unit 3*f* The air conditioner 110 includes a first refrigerant system RS1 and a second refrigerant system RS2 which are two refrigerant systems.

The first outdoor unit 2*a*, the first indoor unit 3*a*, the second indoor unit 3*b*, and the third indoor unit 3*c* form a first refrigerant circuit RC1 that is a core of the first refrigerant system RS1. Therefore, the first outdoor unit 2*a*, the first indoor unit 3*a*, the second indoor unit 3*b*, and the third indoor unit 3*c* are connected by a refrigerant pipe P1, and the same refrigerant circulates in these outdoor unit 2 and indoor units 3. The first refrigerant system RS1 includes the centralized-controller 4 that is used for management or operation of the first refrigerant circuit RC1.

The second outdoor unit 2*b*, the fourth indoor unit 3*d*, the fifth indoor unit 3*e*, and the sixth indoor unit 3*f* form a second refrigerant circuit RC2 that is a core of the second refrigerant system RS2. Therefore, the second outdoor unit 2*b*, the fourth indoor unit 3*d*, the fifth indoor unit 3*e*, and the sixth indoor unit 3*f* are connected by a refrigerant pipe P2, and the same refrigerant circulates in these outdoor unit 2 and indoor units 3. The second refrigerant system RS2 includes the centralized-controller 4 that is used for management or operation of the second refrigerant circuit RC2.

Figure 2:
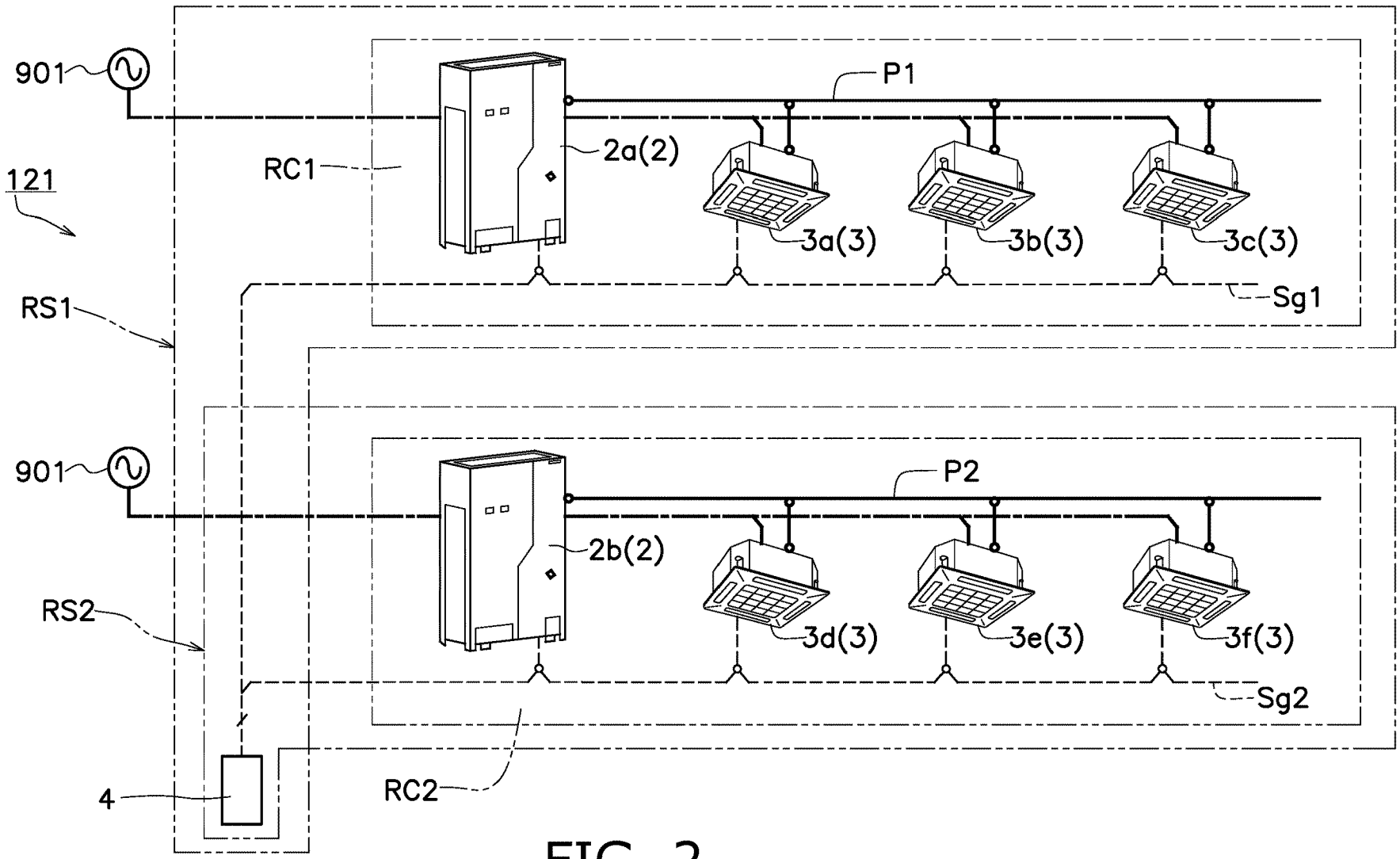
FIG. 2 is a schematic diagram illustrating an example of a configuration of a commercial air conditioner.

(1-2) Commercial Air Conditioner (1-2-1) Commercial Air Conditioner Including Centralized-Controller An air conditioner 121 illustrated in FIG. 2 includes a plurality of outdoor units 2, a plurality of indoor units 3, and a centralized-controller 4, similarly to the multi-split air conditioner 110 in FIG. 1. Also in the commercial air conditioner 121, the plurality of outdoor units 2, the plurality of indoor units 3, and the centralized-controller 4 are connected so as to be able to communicate with each other, to perform air conditioning of a target space.

The air conditioner 121 is a commercial air conditioner. The commercial air conditioner 121 is different from the multi-split air conditioner 110, and the outdoor unit 2 is connected to the commercial power source 901 for electric power supply to the outdoor unit 2, and electric power to the indoor unit 3 is supplied from the commercial power source 901 via the outdoor unit 2, for example. As described above, in the commercial air conditioner 121, the commercial power source 901 for driving the outdoor unit 2 and the indoor unit 3 is in the same line.

The plurality of outdoor units 2 include a first outdoor unit 2*a* and a second outdoor unit 2*b*. The plurality of indoor units 3 include a first indoor unit 3*a*, a second indoor unit 3*b*, a third indoor unit 3*c*, a fourth indoor unit 3*d*, a fifth indoor unit 3*e*, and a sixth indoor unit 3*f* The air conditioner 121 includes a first refrigerant system RS1 and a second refrigerant system RS2 which are two refrigerant systems.

The first outdoor unit 2*a*, the first indoor unit 3*a*, the second indoor unit 3*b*, and the third indoor unit 3*c* form a first refrigerant circuit RC1 that is a core of the first refrigerant system RS1. Therefore, the first outdoor unit 2*a*, the first indoor unit 3*a*, the second indoor unit 3*b*, and the third indoor unit 3*c* are connected by a refrigerant pipe P1, and the same refrigerant circulates in these outdoor unit 2 and indoor units 3. The first refrigerant system RS1 includes the centralized-controller 4 that is used for management or operation of the first refrigerant circuit RC1.

The second outdoor unit 2*b*, the fourth indoor unit 3*d*, the fifth indoor unit 3*e*, and the sixth indoor unit 3*f* form a second refrigerant circuit RC2 that is a core of the second refrigerant system RS2. Therefore, the second outdoor unit 2*b*, the fourth indoor unit 3*d*, the fifth indoor unit 3*e*, and the sixth indoor unit 3*f* are connected by a refrigerant pipe P2, and the same refrigerant circulates in these outdoor unit 2 and indoor units 3. The second refrigerant system RS2 includes the centralized-controller 4 that is used for management or operation of the second refrigerant circuit RC2.

Figure 3:
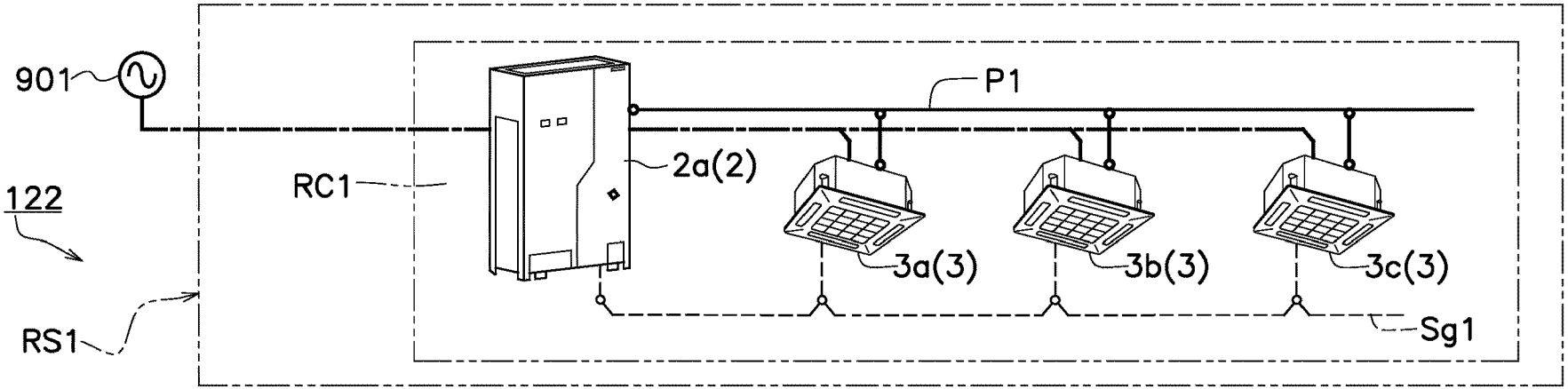
FIG. 3 is a schematic diagram illustrating another example of a configuration of the commercial air conditioner.

(1-2-2) Commercial Air Conditioner in which Indoor Unit does not Communicate with Centralized-Controller An air conditioner 122 illustrated in FIG. 3 includes at least an outdoor unit 2 and a plurality of indoor units 3. In the commercial air conditioner 122, the outdoor unit 2 and the plurality of indoor units 3 are connected so as to be able to communicate with each other, to perform air conditioning of a target space. The commercial air conditioner 121 illustrated in FIG. 2 is different from the commercial air conditioner 122 illustrated in FIG. 3 in whether or not the centralized-controller 4 is directly connected to the indoor unit 3. However, for example, an air conditioner in which the centralized-controller 4 is connected only to the outdoor unit 2 while the indoor unit 3 and the centralized-controller 4 are indirectly connected via the outdoor unit 2 is also the commercial air conditioner 122 in which the indoor unit does not communicate with the centralized-controller. In the air conditioner 122 of such a structure, when viewed from the indoor unit 3, the indoor unit 3 only communicates with the outdoor unit 2, and thus the indoor unit 3 does not need to control communication between with the centralized-controller 4.

The commercial air conditioner 122 is also different from the multi-split air conditioner 110, and the outdoor unit 2 is connected to the commercial power source 901 for electric power supply to the outdoor unit 2, and electric power to the indoor unit 3 is supplied from the commercial power source 901 via the outdoor unit 2, for example.

The plurality of indoor units 3 include a first indoor unit 3*a*, a second indoor unit 3*b*, and a third indoor unit 3*c*. Here, a case where the commercial air conditioner 122 includes the first refrigerant system RS1 which is one refrigerant system will be described, but a plurality of refrigerant systems may be provided similarly to the multi-split air conditioner 110 illustrated in FIG. 1.

The outdoor unit 2, the first indoor unit 3*a*, the second indoor unit 3*b*, and the third indoor unit 3*c* form a first refrigerant circuit RC1 that is a core of the first refrigerant system RS1. Therefore, the outdoor unit 2, the first indoor unit 3*a*, the second indoor unit 3*b*, and the third indoor unit 3*c* are connected by a refrigerant pipe P1, and the same refrigerant circulates in these outdoor unit 2 and plurality of indoor units 3.

Figure 4:
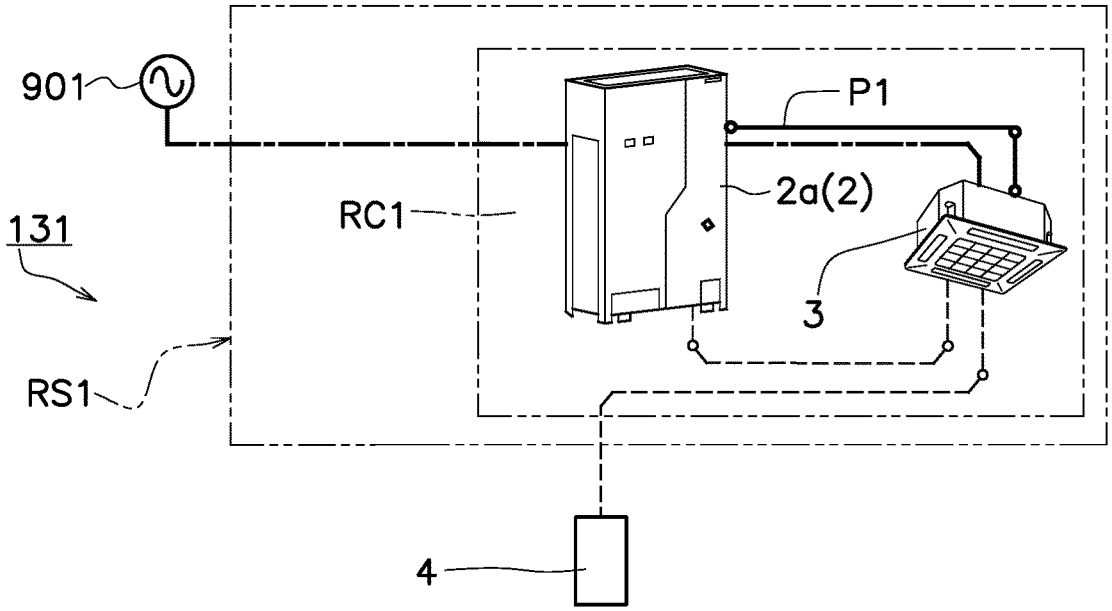
FIG. 4 is a schematic diagram illustrating an example of a configuration of a residential air conditioner.

(1-3) Residential Air Conditioner (1-3-1) Residential Air Conditioner Including Centralized-Controller An air conditioner 131 illustrated in FIG. 4 includes an outdoor unit 2, an indoor unit 3, and a centralized-controller 4, similarly to the commercial air conditioner 121 in FIG. 2. However, each of the numbers of the outdoor units 2 and the indoor units 3 included in the residential air conditioner 131 is one, and the outdoor unit 2 and the indoor unit 3 are paired with each other. In the residential air conditioner 131, the outdoor unit 2 and the indoor unit 3 are connected so as to be able to communicate with each other, and the indoor unit 3 and the centralized-controller 4 are connected so as to be able to communicate with each other, to perform air conditioning of a target space.

Similarly to the commercial air conditioner 121, the outdoor unit 2 of the residential air conditioner 131 is connected to the commercial power source 901 for electric power supply to the outdoor unit 2, and electric power to the indoor unit 3 is supplied from the commercial power source 901 via the outdoor unit 2, for example. As described above, in the residential air conditioner 131, the commercial power source 901 for driving the outdoor unit 2 and the indoor unit 3 is in the same line.

In the residential air conditioner 131, the outdoor unit 2 and the indoor unit 3 are connected by a refrigerant pipe P1, and the same refrigerant circulates in the one outdoor unit 2 and the one indoor unit 3. As described above, a first refrigerant circuit RC1 includes only one outdoor unit 2 and one indoor unit 3, and devices belonging to a first refrigerant system RS1 which is a refrigerant system are limited to the connection between one outdoor unit 2 and one indoor unit 3. Therefore, in the residential air conditioner 131, it is not necessary to perform system recognition to be described later for recognizing to which refrigerant system a plurality of indoor units 3 belongs. The centralized-controller 4 used to manage or operate the indoor unit 3 is connected to the indoor unit 3.

(1-3-2) Residential Air Conditioner without Including Centralized-Controller

Figure 5:
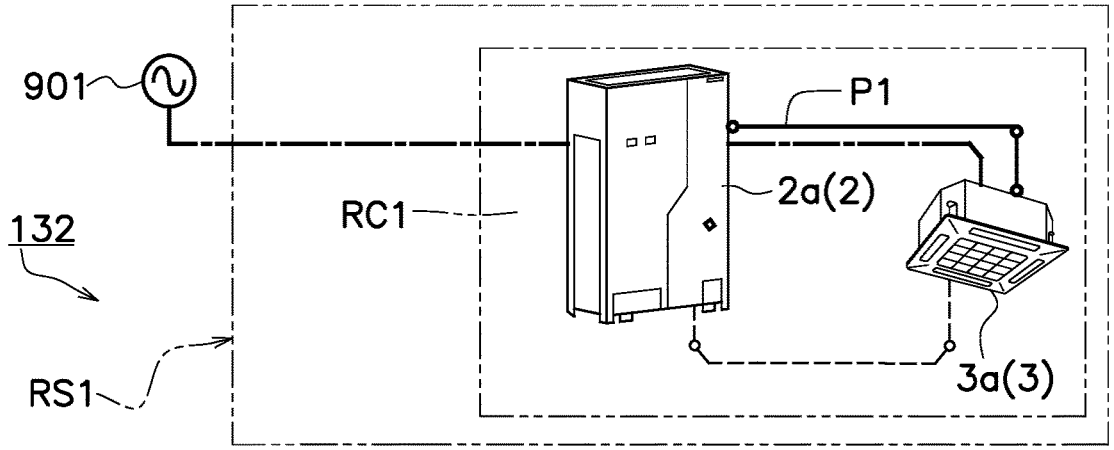
FIG. 5 is a schematic diagram illustrating another example of a configuration of the residential air conditioner.

A residential air conditioner 132 illustrated in FIG. 5 is different from the air conditioner 131 for house use illustrated in FIG. 4 in that the centralized-controller 4 is not provided. However, a configuration of the air conditioner 132 for house use illustrated in FIG. is the same as that of the residential air conditioner 131 illustrated in FIG. 4 except that the centralized-controller 4 is not provided.

(1-4) Configuration of Indoor Unit 3

Figure 6:
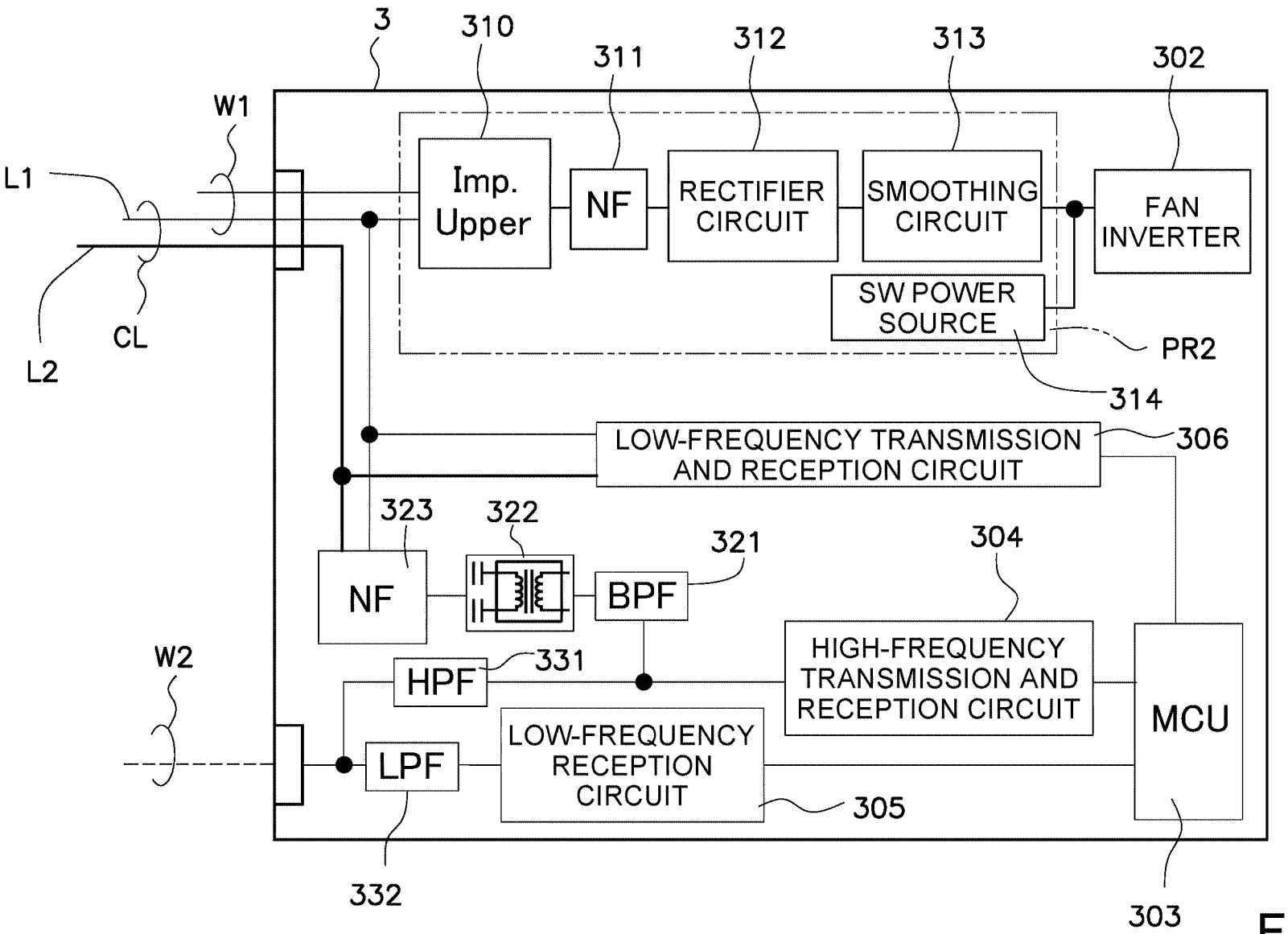
FIG. 6 is a block diagram illustrating an example of a configuration of an indoor unit.

The indoor unit 3 having the same configuration can be used for all the air conditioners 110, 121, 122, 131, and 132 illustrated in FIGS. 1 to 5. FIG. 6 illustrates an example of an internal configuration mainly related to an electric system in an internal configuration of the indoor unit 3. The indoor unit 3 includes a power receiving circuit PR2 that is for receiving electric power from the commercial power source 901 via the outdoor unit 2 illustrated in FIGS. 2 to 5 and supplying electric power to devices inside the indoor unit 3. Further, as illustrated in FIG. 1, this power receiving circuit PR2 can also be connected to the commercial power source 902 to receive electric power supply from the commercial power source 902.

The indoor unit 3 includes a fan inverter 302, an MCU 303, a high-frequency transmission and reception circuit 304, a low-frequency reception circuit 305, and a low-frequency transmission and reception circuit 306, which are driven by electric power supplied to an inside of the indoor unit 3 by the power receiving circuit PR2. The fan inverter 302 is an inverter for operation of a fan (not illustrated) that generates an airflow of indoor air in an indoor heat exchanger (not illustrated) provided in the indoor unit 3. The MCU 303 functions as a inner-controller for control of internal devices of each indoor unit 3.

The power receiving circuit PR2 includes an impedance upper 310, a third noise filter 311, a rectifier circuit 312, a smoothing circuit 313, and a switching power source 314. The impedance upper 310 increases an impedance of the power receiving circuit PR2 to reduce a signal of current loop communication performed through a current loop CL from being suctioned into the power receiving circuit PR2. The third noise filter 311 reduces noise included in electric power supplied from the commercial power source 901 or the commercial power source 902. The rectifier circuit 312 performs rectification to convert AC power whose noise has been reduced by a noise filter 211 into DC power, and outputs the DC power. The smoothing circuit 313 reduces pulsation included in an output of the rectifier circuit 312. The DC power output from the smoothing circuit 313 is supplied to the fan inverter 302 and the switching power source 314. The switching power source 314 converts a voltage into a DC voltage smaller than a voltage supplied from the smoothing circuit 313, and supplies the DC voltage to devices inside the indoor unit 3. The switching power source 314 supplies electric power to, for example, the MCU 303, the high-frequency transmission and reception circuit 304, the low-frequency reception circuit 305, and the low-frequency transmission and reception circuit 306.

The indoor unit 3 can form the current loop CL between with the outdoor unit 2 by using a power line L1 in power supply wiring W1 and a signal line L2 other than the power supply wiring W1. The indoor unit 3 can transmit and receive a low-frequency current signal via the current loop CL by using the low-frequency transmission and reception circuit 306.

The indoor unit 3 includes a band-pass filter 321, a coupling circuit 322, and a fourth noise filter 323. The band-pass filter 321 allows passage of a high-frequency voltage signal transmitted and received by the high-frequency transmission and reception circuit 304. The band-pass filter 321 is connected to wiring of the current loop CL via the coupling circuit 322 and the noise filter 323. For transmission and reception of the high-frequency voltage signal, the coupling circuit 322 is a circuit that does not allow passage of a DC component but allows passage of an AC component, and allows passage of a high-frequency signal transmitted through the wiring of the current loop CL by using the coupling capacitor, for example, and the noise filter 323 reduces noise. The high-frequency transmission and reception circuit 304 can transmit and receive a high-frequency voltage signal via the wiring of the current loop CL. Note that the noise filter 323 can be omitted from the configuration of the indoor unit 3.

The high-frequency transmission and reception circuit 304 of the indoor unit 3 is connected to signal wiring W2 via a high-pass filter 331. The low-frequency reception circuit 305 of the indoor unit 3 is connected to the signal wiring W2 via a low-pass filter 332. The high-frequency transmission and reception circuit 304 can transmit and receive a high-frequency signal through the signal wiring W2. The low-frequency reception circuit 305 of the indoor unit 3 can transmit a low-frequency signal through the signal wiring W2. The low frequency signal and the high-frequency signal transmitted and received through the signal wiring W2 are voltage signals for transmitting information through a change in voltage.

(1-5) Connection Determination of Indoor Unit

The MCU 303 of the indoor unit 3 determines which one of the air conditioners 110, 121, 122, 131, and 132 includes the indoor unit 3, in order to perform air conditioning in cooperation with the outdoor unit 2. The MCU 303 makes selection regarding use of the low-frequency reception circuit 305, the low-frequency transmission and reception circuit 306, and the high-frequency transmission and reception circuit 304, in order to perform air conditioning in cooperation with the outdoor unit 2.

The low-frequency transmission and reception circuit 306 is a first reception circuit capable of receiving a current signal transmitted from the outdoor unit 2 by using the current loop CL. The low-frequency reception circuit 305 is a second reception circuit that receives a low-frequency voltage signal for communication using a change in voltage, by using the signal wiring W2 other than the power supply wiring W1. The high-frequency transmission and reception circuit 304 is a transmission and reception circuit that can transmit and receive a voltage signal for communication using a change in voltage. The high-frequency transmission and reception circuit 304 may transmit and receive a voltage signal for communication using a change in voltage via the wiring of the current loop CL, or may transmit and receive a voltage signal via the signal wiring W2.

Figure 7:
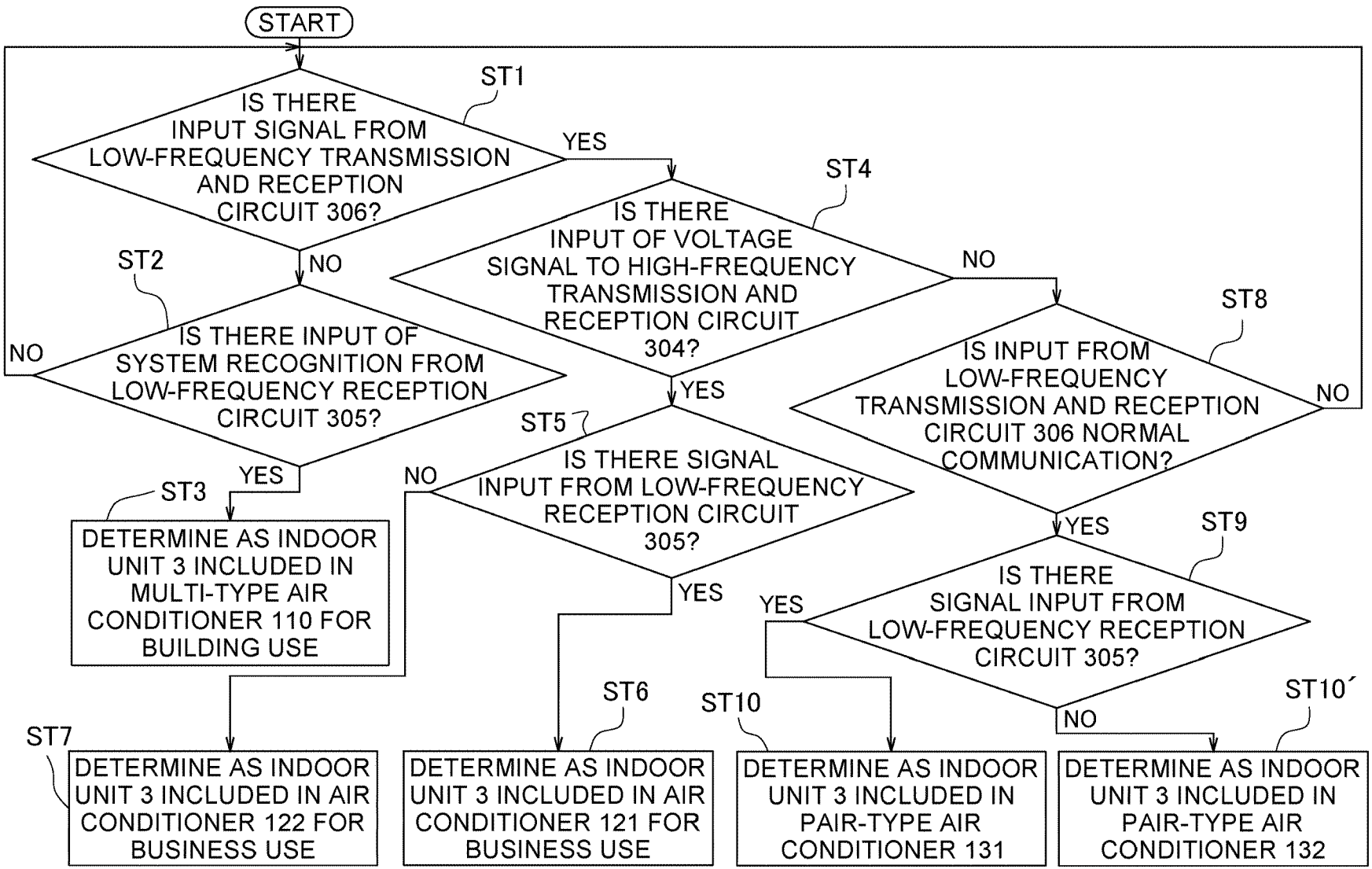
FIG. 7 is a flowchart illustrating an example of a determination procedure of an air conditioner in which the indoor unit is incorporated.

The MCU 303 of the indoor unit 3 determines which one of the air conditioners 110, 121, 122, 131, and 132 includes the indoor unit 3, for example, in accordance with a determination flow illustrated in FIG. 7. First, it is determined whether or not there is an input signal from the low-frequency transmission and reception circuit 306 (step ST1). In other words, it is determined whether or not a current signal is received by using the current loop CL. If there is no input signal from the low-frequency transmission and reception circuit 306 (No in step ST1), the MCU 303 determines whether or not there is an input of system recognition from the low-frequency reception circuit 305 (step ST2). If there is an input of system recognition from the low-frequency reception circuit 305 (Yes in step ST2), the MCU 303 determines that the indoor unit 3 is included in the multi-split air conditioner 110 as illustrated in FIG. 1 (step ST3). If the MCU 303 determines that there is no input of system recognition from the low-frequency reception circuit 305 (No in step ST2), the process returns to step ST1 to repeat the determination.

If the MCU 303 determines that there is an input signal from the low-frequency transmission and reception circuit 306 (Yes in step ST1), the MCU 303 determines whether or not there is an input of a voltage signal to the high-frequency transmission and reception circuit 304 (step ST4). In other words, the MCU 303 determines whether or not high-frequency communication used for air conditioning by the indoor unit 3 and low-frequency communication for system recognition are transmitted and received through the same wiring of the current loop CL. If there is an input of a voltage signal to the high-frequency transmission and reception circuit 304 (Yes in step ST4), the MCU 303 determines whether or not there is a signal input from the low-frequency reception circuit 305 (step ST5). If there is a signal input from the low-frequency reception circuit 305 (Yes in step ST5), the MCU 303 determines that the indoor unit 3 is included in the commercial air conditioner 121 as illustrated in FIG. 2 (step ST6). If there is no signal input from the low-frequency reception circuit 305 (No in step ST5), the MCU 303 determines that the indoor unit 3 is included in the commercial air conditioner 122 described with reference to FIG. 3 (step ST7).

If there is no input of a voltage signal to the high-frequency transmission and reception circuit 304 (No in step ST4), the MCU 303 determines whether or not the input from the low-frequency transmission and reception circuit 306 is normal communication between with the outdoor unit 2 (step ST8). Here, the normal communication between with the outdoor unit 2 is communication for operation of the residential air conditioners 131 and 132, other than communication for system recognition. If the MCU 303 determines that the input from the low-frequency transmission and reception circuit 306 is the normal communication (Yes in step ST8), the MCU 303 determines whether or not there is a signal input to the low-frequency reception circuit 305 (step ST9). If there is a signal input from the low-frequency reception circuit 305 (Yes in step ST9), the MCU 303 determines that the indoor unit 3 is included in the residential air conditioner 131 illustrated in FIG. 4 (step ST10). If there is no signal input from the low-frequency reception circuit 305 (No in step ST9), the MCU 303 determines that the indoor unit 3 is included in the residential air conditioner 132 illustrated in FIG. 5 (step ST10'). If the MCU 303 determines that the input from the low-frequency transmission and reception circuit 306 is not the normal communication (No in step ST8), the process returns to step ST1 to repeat the determination.

(1-6) Selection Related to Communication of Indoor Unit

The MCU 303 selects a communication circuit to be used for communication of the indoor unit 3, on the basis of the determination results of steps ST3, ST6, ST7, ST10, and ST10'.

If the MCU 303 determines that the indoor unit 3 is included in the multi-split air conditioner 110 (step ST3), the MCU 303 selects use of the low-frequency reception circuit 305 as the communication circuit to be used in the first communication state for recognizing physical connection between with the outdoor unit 2. In other words, the first communication state is a communication state for performing system recognition. The indoor unit 3 of the air conditioner 110 uses the signal wiring W2 and the low-frequency reception circuit 305 to make selection related to communication for performing system recognition using a low-frequency voltage signal. This system recognition enables communication for operation of the air conditioner 110 between the outdoor unit 2, the indoor unit 3, and the centralized-controller 4. After the system recognition is completed, the MCU 303 selects use of the high-frequency transmission and reception circuit 304 as the communication circuit to be used in the second communication state in which communication for operation of the air conditioner 110 is performed between with the outdoor unit 2. In the communication for operation of the multi-split air conditioner 110, transmission and reception using a high-frequency voltage signal is performed between the outdoor unit 2 and the indoor unit 3, by using the high-frequency transmission and reception circuit 304 and the signal wiring W2. In the multi-split air conditioner 110, high-frequency communication used for air conditioning of the indoor unit 3 and low-frequency communication for system recognition are transmitted through the same signal wiring W2.

If the MCU 303 determines that the indoor unit 3 is included in the commercial air conditioner 121 (step ST6), the MCU 303 selects use of the low-frequency reception circuit 305 and the low-frequency transmission and reception circuit 306 as the communication circuit to be used in the communication state for performing system recognition. The indoor unit 3 of the air conditioner 121 performs system recognition by using a low-frequency current signal, by using the low-frequency transmission and reception circuit 306 and the current loop CL, and makes selection related to communication for performing system recognition using a low-frequency voltage signal by using the low-frequency reception circuit 305 and the signal wiring W2. The low-frequency transmission and reception circuit 306 and the current loop CL are used to perform system recognition between the indoor unit 3 and the outdoor unit 2, and the low-frequency reception circuit 305 and the signal wiring W2 are used to perform system recognition between the indoor unit 3, the outdoor unit 2, and the centralized-controller 4. In this manner, two types of system recognition are performed for the two communication means (communication means using the low-frequency transmission and reception circuit 306 and the current loop CL, and communication means using the low-frequency reception circuit 305 and the signal wiring W2) included in the air conditioner 121. These types of system recognition enable communication for operation of the air conditioner 121 between the outdoor unit 2, the indoor unit 3, and the centralized-controller 4.

After the system recognition is completed, the MCU 303 selects use of the high-frequency transmission and reception circuit 304 as the communication circuit to be used in the second communication state in which communication for operation of the air conditioner 121 is performed between the outdoor unit 2 and the centralized-controller 4. In the communication for operation of the commercial air conditioner 121, transmission and reception using a high-frequency voltage signal is performed between the outdoor unit 2, the indoor unit 3, and the centralized-controller 4, by using the high-frequency transmission and reception circuit 304, the wiring of the current loop CL, and the signal wiring W2. In the commercial air conditioner 121, high-frequency communication used for air conditioning by the indoor unit 3 and low-frequency communication for system recognition are transmitted and received through the same wiring of the current loop CL, and high-frequency communication used for air conditioning of the indoor unit 3 and low-frequency communication for system recognition are transmitted through the same signal wiring W2. Since wiring using the current loop CL for the centralized-controller 4 is not practical, a communication means using the signal wiring W2, which is a communication means other than the communication means using the current loop CL, is used in a case where the centralized-controller 4 is included in the same system.

If the MCU 303 determines that the indoor unit 3 is included in the commercial air conditioner 122 (step ST7), the MCU 303 selects use of the low-frequency transmission and reception circuit 306 as the communication circuit to be used in the communication state for performing system recognition. The indoor unit 3 of the air conditioner 121 make selection related to communication for performing system recognition by using a low-frequency current signal, by using the low-frequency transmission and reception circuit 306 and the current loop CL. This system recognition enables communication for operation of the air conditioner 122 between the outdoor unit 2 and the indoor unit 3. After the system recognition is completed, the MCU 303 selects use of the high-frequency transmission and reception circuit 304 as the communication circuit to be used in the second communication state in which communication for operation of the air conditioner 122 is performed between with the outdoor unit 2. In the communication for operation of the commercial air conditioner 122, transmission and reception using a high-frequency voltage signal is performed between the outdoor unit 2 and the indoor unit 3, by using the high-frequency transmission and reception circuit 304 and wiring of the current loop CL. In the commercial air conditioner 122, high-frequency communication used for air conditioning by the indoor unit 3 and low-frequency communication for system recognition are transmitted and received through the same wiring of the current loop CL.

If the MCU 303 determines that the indoor unit 3 is included in the residential air conditioner 131 (step ST10), the MCU 303 does not select any circuit as the communication circuit to be used in the communication state for performing system recognition. In other words, the MCU 303 recognizes that communication between with the connected outdoor unit 2 can be performed for operation of the air conditioner 131 without performing system recognition. In addition, the MCU 303 establishes communication between with the centralized-controller 4 through communication different from communication for system recognition, by using the signal wiring W2. The MCU 303 selects use of the high-frequency transmission and reception circuit 304 and the low-frequency transmission and reception circuit 306 as the communication circuits to be used in the second communication state in which communication for operation of the air conditioner 131 is performed between the outdoor unit 2 and the centralized-controller 4. The current loop CL and the low-frequency transmission and reception circuit 306 are used for communication between with the outdoor unit 2 for operation of the residential air conditioner 131, and the signal wiring W2 and the high-frequency transmission and reception circuit 304 are used for communication between with the centralized-controller 4 for operation of the residential air conditioner 131.

If the MCU 303 determines that the indoor unit 3 is included in the residential air conditioner 132 (step ST10'), the MCU 303 does not select any circuit as the communication circuit to be used in the communication state for performing system recognition. In other words, the MCU 303 recognizes that communication between with the connected outdoor unit 2 can be performed for operation of the air conditioner 132 without performing system recognition. The MCU 303 selects use of the low-frequency transmission and reception circuit 306 as the communication circuit to be used in the second communication state in which communication for operation of the air conditioner 132 is performed between with the outdoor unit 2. The current loop CL and the low-frequency transmission and reception circuit 306 are used for communication between with the outdoor unit 2 for operation of the residential air conditioner 132.

(2) System Recognition and Communication in Air Conditioner

The air conditioners 110, 121, and 122 perform high-frequency communication used for air-conditioning control and low-frequency communication for checking device connection in the system, by using the same communication path. These air conditioners 110, 121, and 122 use signals of at least two different frequencies of a high-frequency signal and a low-frequency signal for system recognition. The high-frequency signal is a signal having a higher frequency than the low frequency signal. Here, communication performed using the high-frequency signal is high-frequency communication, and communication performed using the low-frequency signal is low-frequency communication. In the present disclosure, the high-frequency signal is a signal having a frequency of 100 kHz or more, and the low frequency signal is a signal having a frequency of 10 kHz or less.

(2-1) Communication for System Recognition

As described above, the air conditioners 110, 121, and 122 transfer thermal energy by using a refrigerant between the outdoor unit 2 and the indoor unit 3, in order to make the refrigerant circulate between the outdoor unit 2 and the indoor unit 3 to perform air conditioning of a target space. Therefore, the air conditioners 110, 121, and 122 recognize a communication target in accordance with the circulation of the refrigerant before performing an operation for air conditioning. In the air conditioners 110, 121, and 122, the recognition of the communication target suitable for the circulation of the refrigerant is the system recognition.

A concept of system recognition common in the present disclosure is to recognize devices belonging to the same system related to the same medium that carries thermal energy. To the same system recognized by the system recognition, the outdoor unit 2 and the indoor unit 3 constituting a physically connected path that carries thermal energy for performing air conditioning belong, and the centralized-controller 4 used for management or operation of the outdoor unit 2 and the indoor unit 3 belongs. The medium that carries thermal energy includes a refrigerant used in a vapor compression refrigeration cycle, air used in a total air heat transport system, and water or a heat medium made circulate while managing a liquid temperature.

Figure 8:
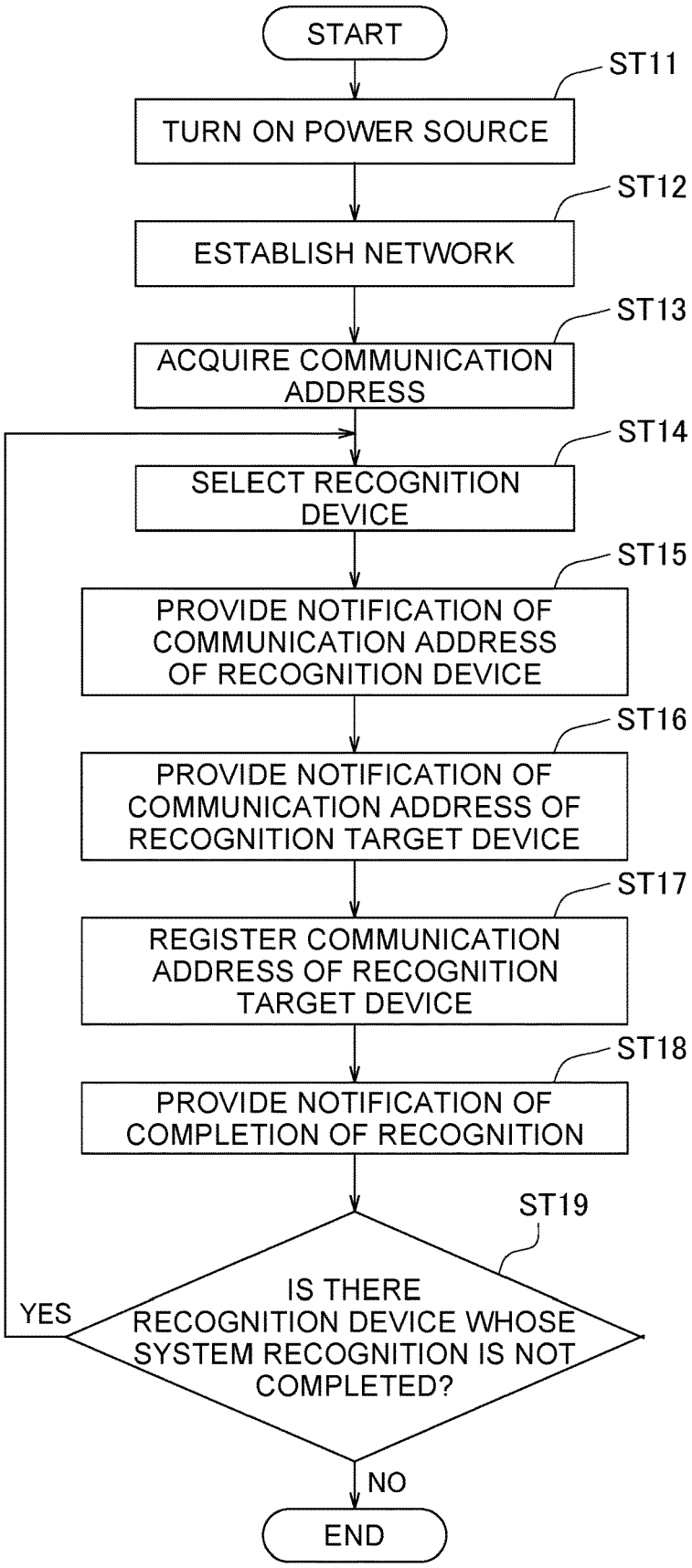
FIG. 8 is a flowchart illustrating an example of an operation of the air conditioner for system recognition.

Communication of the air conditioners 110, 121, and 122 when performing system recognition will be described with reference to FIG. 8. First, a power source of the air conditioners 110, 121, and 122 is turned ON in order to perform communication for system recognition (step ST11). The first outdoor unit 2*a*, the first indoor unit 3*a*, the second indoor unit 3*b*, the third indoor unit 3*c*, and the centralized-controller 4 that are connected to first signal wiring Sg1, or for the air conditioners 110 and 121, the second outdoor unit 2*b*, the fourth indoor unit 3*d*, the fifth indoor unit 3*e*, the sixth indoor unit 3*f*, and the centralized-controller 4 that are connected to second signal wiring Sg2 establish a network for communication (step ST12). In the air conditioners 110 and 121, for example, a network is established by the first outdoor unit 2*a* or the second outdoor unit 2*b* transmitting and receiving a communication signal to and from a constituent device connected to the first signal wiring Sg1 and the second signal wiring Sg2, by using a high-frequency signal. In the air conditioner 122, for example, the outdoor unit 2 establishes a network by transmitting and receiving a communication signal to and from a constituent device connected to the first signal wiring Sg1, by using a high-frequency signal.

After establishment of the network, each of the constituent devices acquires a communication address (step ST13). The constituent device includes, for example, a micro-inner-controller (MCU), and has a function of automatically acquiring a communication address by using the MCU. The constituent devices can acquire communication addresses that do not overlap with each other, by using the functions described above.

In a case where the outdoor unit 2 or the centralized-controller 4 is provided, the outdoor unit 2 and the centralized-controller 4 cooperate through communication using a high-frequency signal, and select one recognition device on the network (step ST14). In a case of the air conditioners 110 and 121 in FIGS. 1 and 2, the first outdoor unit 2*a*, the second outdoor unit 2*b*, and the centralized-controller 4 are in a competitive relationship, but any of them is set in advance to be selected. For example, among the first outdoor unit 2*a*, the second outdoor unit 2*b*, and the centralized-controller 4, a device that has previously transmitted a high-frequency signal is set to be selected as a recognition device. In a case of the air conditioner 122 in FIG. 3, since there is no device in a competitive relationship, the recognition device is determined to be the outdoor unit 2.

The air conditioners 110 and 121 in FIGS. 1 and 2 will be described below. In the air conditioner 110 and 121 in FIGS. 1 and 2, for example, a case where the first outdoor unit 2*a* is selected will be described. When the first outdoor unit 2*a* is selected, the second outdoor unit 2*b* and the centralized-controller 4 change a role from a candidate of the recognition device to a recognition target device. Changing the role from the candidate for the recognition device to the recognition target device means that, in other words, the second outdoor unit 2*b* and the centralized-controller 4 can receive a low frequency signal sent from the first outdoor unit 2*a*.

The selected recognition device transmits a low frequency signal in order to recognize the refrigerant system (step ST15). For example, when the first outdoor unit 2*a* is selected, the first outdoor unit 2*a* transmits a low frequency signal to the first signal wiring Sg1 to recognize the first refrigerant system RS1. The low frequency signal transmitted using the first signal wiring Sg1 is not transmitted to the second outdoor unit 2*b*, the fourth indoor unit 3*d*, the fifth indoor unit 3*e*, and the sixth indoor unit 3*f* connected to the second signal wiring Sg2. In order to prevent the low frequency signal transmitted to the first signal wiring Sg1 from being transmitted to the second signal wiring Sg2, for example, the first signal wiring Sg1 and the second signal wiring Sg2 are connected via a high-pass filter (not illustrated) that allows passage of a high-frequency signal but does not allow passage of a low-frequency signal.

The first outdoor unit 2*a* transmits the own communication address with a high-frequency signal simultaneously with transmission of the low frequency signal or before or after transmission of the low frequency signal. The first indoor unit 3*a*, the second indoor unit 3*b*, the third indoor unit 3*c*, and the centralized-controller 4 having received the low frequency signal through the first signal wiring Sg1 and having received the communication address of the first outdoor unit 2*a* with the high-frequency signal store the received communication address (communication address of the first outdoor unit 2*a*) into a memory (not illustrated) of each MCU.

The recognition target device having received the low frequency signal and the communication address of the recognition device transmits the own communication address to the communication address of the recognition device, by using a high-frequency signal (step ST16). When the first outdoor unit 2*a* is selected, the first indoor unit 3*a*, the second indoor unit 3*b*, the third indoor unit 3*c*, and the centralized-controller 4 transmit the own communication addresses to the communication address of the first outdoor unit 2*a* through the first signal wiring Sg1, by using a high-frequency signal. When the first outdoor unit 2*a* is selected, the second outdoor unit 2*b*, the fourth indoor unit 3*d*, the fifth indoor unit 3*e*, and the sixth indoor unit 3*f* have not received the low-frequency signal from the first outdoor unit 2*a*, and thus do not transmit the own communication addresses to the first outdoor unit 2*a*.

The selected recognition device registers the constituent device having the sent communication address of the recognition target device, into a same system list (step ST17). When the first outdoor unit 2*a* is selected, the first outdoor unit 2*a* sequentially adds the communication addresses of the first indoor unit 3*a*, the second indoor unit 3*b*, the third indoor unit 3*c*, and the centralized-controller 4 sent to the own communication addresse through the first signal wiring Sg1, to the same system list. By holding the same system list, the first outdoor unit 2*a* can recognize which constituent device other than the first outdoor unit 2*a* is a constituent device belonging to the first refrigerant system RS1, in addition to the first outdoor unit 2*a*.

Upon completing the registration of all the recognition target devices in the refrigerant system to which the selected recognition device belongs, the selected recognition device notifies the entire network that the system recognition of the refrigerant system to which the selected recognition device belongs is completed (step ST18). When the first outdoor unit 2*a* is selected, upon completing the registration of the constituent devices connected to the first signal wiring Sg1, the first outdoor unit 2*a* notifies the entire network that the system recognition of the first refrigerant system RS1 is completed, through the first signal wiring Sg1 and the second signal wiring Sg2.

Upon receiving the notification that the system recognition of one refrigerant system is completed, it is determined whether or not there is a recognition device whose system recognition is not completed (step ST19). If the first outdoor unit 2*a* is selected first, the system recognition of the second refrigerant system RS2 by the second outdoor unit 2*b* is not completed even if the system recognition by the first outdoor unit 2*a* is completed (Yes in step ST19). In such a case, the outdoor unit 2 and the centralized-controller 4 cooperate through communication using a high-frequency signal, and select the second outdoor unit 2*b* as the recognition device (step ST14). After the second outdoor unit 2*b* is selected as the recognition device, the operations from step ST15 to step ST19 are repeated similarly to the case where the first outdoor unit 2*a* is selected. Through these operations, system recognition of the constituent devices of the second refrigerant system RS2 is performed.

In the example of the communication for the system recognition described above, a case has been described in which a communication destination or a communication source is specified using the communication address, through communication using a high-frequency signal through the first signal wiring Sg1 and the second signal wiring Sg2. However, the specification of the communication destination or the communication source is not limited to the specification using the communication address. For example, the air conditioners 110 and 121 may be configured to specify the communication destination or the communication source by using a unique ID owned by each of the plurality of outdoor units 2, the plurality of indoor units, and the centralized-controller 4.

(2-2) Communication after System Recognition

When the system recognition is completed, in the same system list of the first outdoor unit 2*a*, the communication addresses of the first indoor unit 3*a*, the second indoor unit 3*b*, the third indoor unit 3*c*, and the centralized-controller 4 connected to the first signal wiring Sg1 are registered as the first refrigerant system RS1, and the communication addresses of the fourth indoor unit 3*d*, the fifth indoor unit 3*e*, the sixth indoor unit 3*f*, and the centralized-controller 4 are registered as the second refrigerant system RS2.

The first outdoor unit 2*a* can specify the first indoor unit 3*a*, the second indoor unit 3*b*, the third indoor unit 3*c*, and the centralized-controller 4 belonging to the same refrigerant system by using the same system list. By mutual transmission of data by the first outdoor unit 2*a*, and the first indoor unit 3*a*, the second indoor unit 3*b*, the third indoor unit 3*c*, and the centralized-controller 4 having been specified, the vapor compression refrigeration cycle of the first refrigerant system RS1 can be appropriately performed.

(2-3) Difference in Communication Circuit of Indoor Unit Due to Difference in Configuration of Air Conditioner The indoor unit 3 (the first indoor unit 3*a*, the second indoor unit 3*b*, the third indoor unit 3*c*, the fourth indoor unit 3*d*, the fifth indoor unit 3*e*, and the sixth indoor unit 3*f*) of the air conditioner 110 uses the low-frequency reception circuit 305 and signal wiring W2, for communication for system recognition. The indoor unit 3 of the air conditioner 110 uses the high-frequency transmission and reception circuit 304 and the signal wiring W2, for communication for operation of the air conditioner 110 after system recognition.

The indoor unit 3 of the air conditioners 121 and 122 uses the low-frequency transmission and reception circuit 306 and the current loop CL, for communication for system recognition. The indoor unit 3 of the air conditioners 121 and 122 uses the high-frequency transmission and reception circuit 304 and wiring of the current loop CL, for communication for operation of the air conditioners 121 and 122 after system recognition.

(2-3-1) Communication During Initial Operation of Air Conditioner 1

For example, in an initial operation state in which the air conditioners 110 and 121 are installed and activated first, the air conditioner 1 can appropriately operate the first refrigerant circuit RC1 by distinguishing the first outdoor unit 2*a*, the first indoor unit 3*a*, the second indoor unit 3*b*, and the third indoor unit 3*c* from other constituent devices. For activation after installation of the first refrigerant circuit RC1, the high-frequency signal transmitted from the outdoor unit 2, the indoor unit 3, or the centralized-controller 4 belonging to the first refrigerant system RS1 is transmitted not only to the first signal wiring Sg1 but also to the second signal wiring Sg2. However, the high-frequency signal transmitted for activating the first refrigerant circuit RC1 is a high-frequency signal irrelevant to the second refrigerant system RS2 to which the second outdoor unit 2*b*, the fourth indoor unit 3*d*, the fifth indoor unit 3*e*, and the sixth indoor unit 3*f* belong. Since the system recognition has been completed, the outdoor unit 2 and the indoor unit 3 included in the second refrigerant circuit RC2 will no longer use data included in the high-frequency signal transmitted from the constituent device belonging to the first refrigerant system RS1 for activating the first refrigerant circuit RC1, as the information for normal operation of the second refrigerant circuit RC2. For example, an instruction from the first outdoor unit 2*a* to the indoor unit 3 belonging to the first refrigerant circuit RC1 can be performed using a high-frequency signal through the first signal wiring Sg1. At this time, the high-frequency signal transmitted from the first outdoor unit 2*a* is also transmitted to the second signal wiring Sg2, but the second refrigerant circuit RC2 is out of the system for the first outdoor unit 2*a*. Therefore, the high-frequency signal transmitted from the first outdoor unit 2*a* is not recognized as a signal for activating the indoor unit 3 included in the second refrigerant circuit RC2. Similarly, in an initial state of the air conditioners 110 and 121, the air conditioners 110 and 121 can appropriately operate the second refrigerant circuit RC2 by distinguishing the second outdoor unit 2*b*, the fourth indoor unit 3*d*, the fifth indoor unit 3*e*, and the sixth indoor unit 3*f* from other constituent devices. For example, an instruction from the second outdoor unit 2*b* to the indoor unit 3 belonging to the second refrigerant circuit RC2 can be performed using a high-frequency signal through the second signal wiring Sg2. The initial state of the air conditioners 110 and 121 is a state in which information regarding a past operation state of the air conditioners 110 and 121 cannot be continuously used for the operation at that time. For example, when the air conditioners 110 and 121 are first activated after installation, when the air conditioners 110 and 121 are first activated after update, and the like, the operation newly starts without considering a state before activation and before update. The air conditioners 110 and 121 being first activated after installation and the air conditioners 110 and 121 being first activated after update are examples of the initial state of the air conditioners 110 and 121.

(2-3-2) Communication when Air Conditioners 110 and 121 are in Normal Operating State When the first refrigerant system RS1 of the air conditioners 110 and 121 is in the normal operating state, the first outdoor unit 2*a*, the first indoor unit 3*a*, the second indoor unit 3*b*, the third indoor unit 3*c*, and the centralized-controller 4 can communicate with each other using a high-frequency signal, and can exchange information necessary for an operation of the first refrigerant system RS1 with each other. Further, when the second refrigerant system RS2 of the air conditioners 110 and 121 is in the normal operating state, the second outdoor unit 2*b*, the fourth indoor unit 3*d*, the fifth indoor unit 3*e*, the sixth indoor unit 3*f*, and the centralized-controller 4 can communicate with each other using a high-frequency signal, and can exchange information necessary for operation of the second refrigerant system RS2 with each other.

The high-frequency signal transmitted, which is for sending information on normal operation of the first refrigerant circuit RC1, from the outdoor unit 2, the indoor unit 3, or the centralized-controller 4 belonging to the first refrigerant system RS1 is transmitted not only to the first signal wiring Sg1 but also to the second signal wiring Sg2. However, the high-frequency signal for sending the information related to the normal operation of the first refrigerant circuit RC1 is a high-frequency signal irrelevant to the second refrigerant system RS2 to which the second outdoor unit 2*b*, the fourth indoor unit 3*d*, the fifth indoor unit 3*e*, and the sixth indoor unit 3*f* belong. Since the system recognition has been completed, the outdoor unit 2 and the indoor unit 3 included in the second refrigerant circuit RC2 will no longer use data included in the high-frequency signal transmitted from the constituent device belonging to the first refrigerant system RS1 for the normal operation of the first refrigerant circuit RC1, as the information for the normal operation of the second refrigerant circuit RC2. For example, during the normal operation, the first outdoor unit 2*a* can instruct the first indoor unit 3*a*, the second indoor unit 3*b*, or the third indoor unit 3*c*, which are constituent devices belonging to the first refrigerant system RS1, to change an air conditioning capacity through the first signal wiring Sg1 by using a high-frequency signal. At this time, the high-frequency signal transmitted from the first outdoor unit 2*a* is also transmitted to the second signal wiring Sg2, but the second refrigerant circuit RC2 is out of the system for the first outdoor unit 2*a*. Therefore, the high-frequency signal transmitted from the first outdoor unit 2*a* is not recognized as a signal for changing the air conditioning capacity of the indoor unit 3 included in the second refrigerant circuit RC2. During the normal operation, the second outdoor unit 2*b* can instruct the indoor unit 3 belonging to the second refrigerant system RS2 to change an air conditioning capacity through the second signal wiring Sg2 by using the high-frequency signal, similarly to the normal operation of the first outdoor unit 2*a* described above.

(3) Connection of Wiring Between Outdoor Unit 2 and Indoor Unit 3

Figure 9:
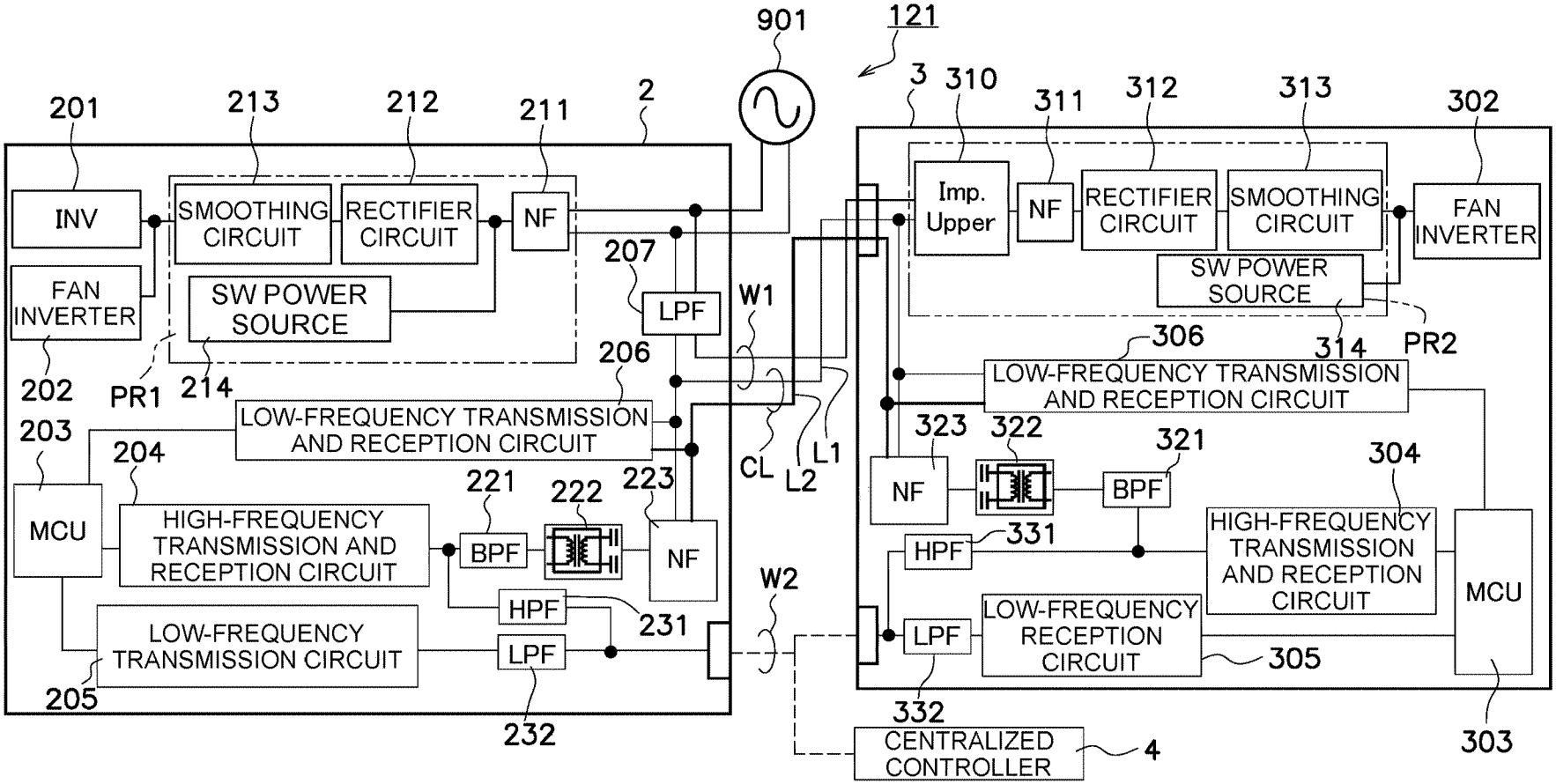
FIG. 9 is a block diagram for explaining a configuration related to communication between an outdoor unit and an indoor unit constituting the commercial air conditioner.
Figure 10:
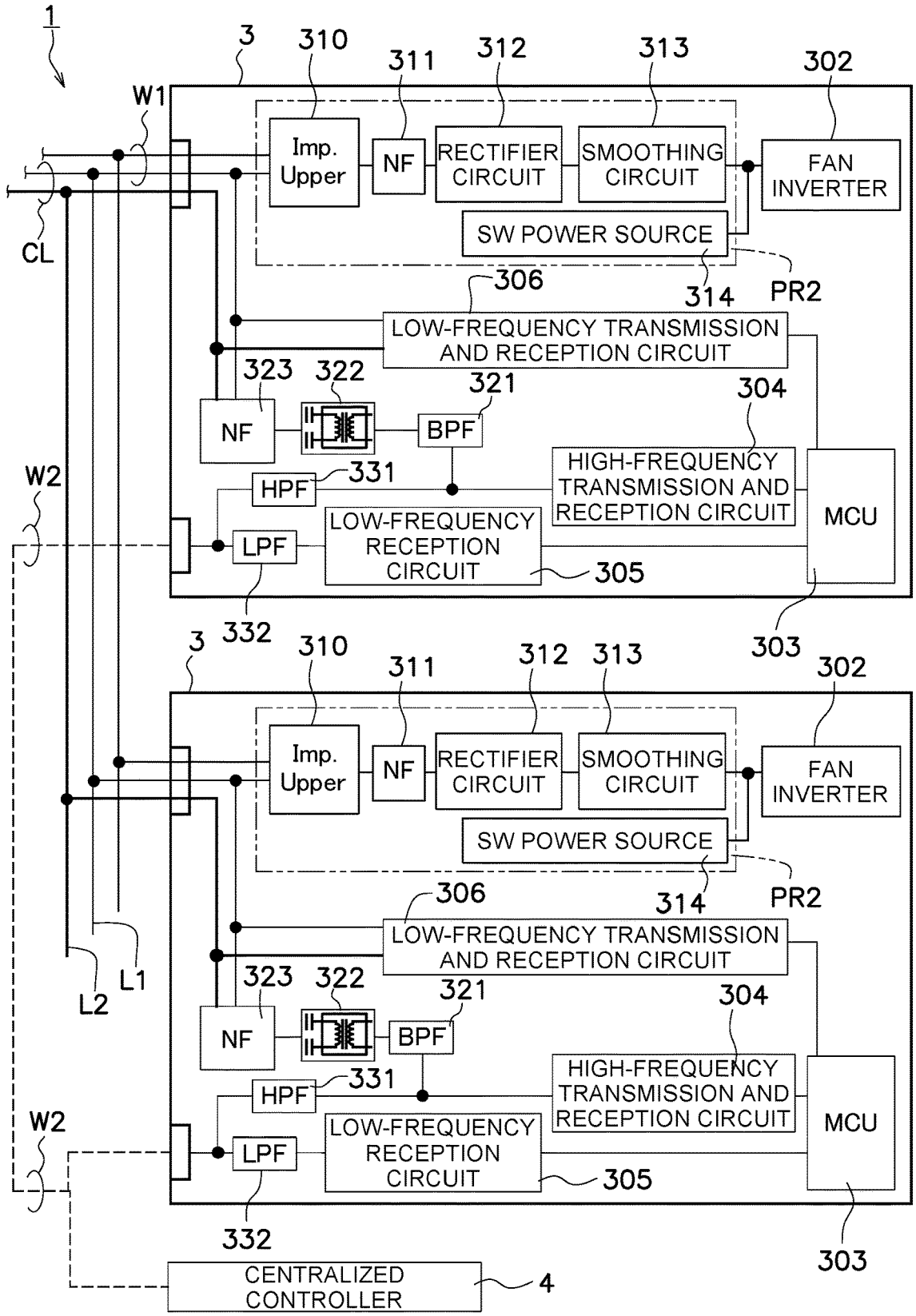
FIG. 10 is a block diagram illustrating an example of connection of a plurality of indoor units in the air conditioner of FIG. 9.

FIGS. 9 and 10 illustrate an example of connection between the outdoor unit 2 and the indoor unit 3 of the commercial air conditioner 121. In a case where the indoor unit 3 is used in the commercial air conditioner 121, the indoor unit 3 is supplied with electric power from the outdoor unit 2. Electric power is supplied from the commercial power source 901 to the outdoor unit 2.

(3-1) Outdoor Unit

The outdoor unit 2 includes a power receiving circuit PR1 that is for receiving electric power from the commercial power source 901 and supplying electric power to devices inside the outdoor unit 2. The outdoor unit 2 includes an inverter 201, a fan inverter 202, an MCU 203, a high-frequency transmission and reception circuit 204, a low-frequency transmission circuit 205, and a low-frequency transmission and reception circuit 206, which are driven by electric power supplied to the inside of the outdoor unit 2 through the power receiving circuit PR1. The inverter 201 supplies, for example, electric power for driving a compressor (not illustrated) to the compressor. The fan inverter 202 is an inverter for operating a fan (not illustrated) that generates an airflow of outdoor air in an outdoor heat exchanger (not illustrated) provided in the outdoor unit 2. The MCU 203 functions as a inner-controller for controlling internal devices of the outdoor unit 2.

The power receiving circuit PR1 includes a first noise filter 211, a rectifier circuit 212, a smoothing circuit 213, and a switching power source 214. The first noise filter 211 reduces noise included in electric power supplied from the commercial power source 901. The rectifier circuit 212 performs rectification to convert AC power whose noise has been reduced by the noise filter 211 into DC power, and outputs the DC power. The smoothing circuit 213 reduces pulsation included in an output of the rectifier circuit 212. The DC power output from the smoothing circuit 213 is supplied to the inverter 201 and the fan inverter 202. The switching power source 214 performs rectification to convert AC power whose noise has been reduced by the noise filter 211 into DC power, and outputs the DC power to devices inside the outdoor unit 2. The switching power source 214 supplies electric power to, for example, the MCU 203, the high-frequency transmission and reception circuit 204, the low-frequency transmission circuit 205, and the low-frequency transmission and reception circuit 206.

The outdoor unit 2 is connected with the power supply wiring W1 for electric power supply from the commercial power source 901 to the indoor unit 3. The outdoor unit 2 includes a low-pass filter 207 for reduction of high-frequency noise superimposed on electric power, in order to apply electric power to the indoor unit 3 through the power supply wiring W1.

The outdoor unit 2 forms the current loop CL between with the indoor unit 3 by using the power line L1 in the power supply wiring W1 and the signal line L2 other than the power supply wiring W1. In the outdoor unit 2, the low-frequency transmission and reception circuit 206 transmits and receives a low-frequency current signal via the current loop CL. In the low-frequency transmission and reception circuit 206 of the outdoor unit 2 and the low-frequency transmission and reception circuit 306 of the indoor unit 3, a frequency of a current signal is preferably set to be the same as a frequency of the commercial power source 901 applied to the power supply wiring W1.

The outdoor unit 2 includes a band-pass filter 221, a coupling circuit 222, and a second noise filter 223. The band-pass filter 221 allows passage of a high-frequency voltage signal transmitted and received by the high-frequency transmission and reception circuit 204. The band-pass filter 221 is connected to the current loop CL via the coupling circuit 222 and the noise filter 223. In order to transmit and receive a high-frequency voltage signal, the coupling circuit 222 does not allow passage of a DC component but allows passage of an AC component, and the noise filter 223 reduces noise. The high-frequency transmission and reception circuit 204 can transmit and receive a high-frequency voltage signal via wiring of the current loop CL.

The high-frequency transmission and reception circuit 204 of the outdoor unit 2 is connected to the signal wiring W2 via a high-pass filter 231. The low-frequency transmission circuit 205 of the outdoor unit 2 is connected to the signal wiring W2 via a low-pass filter 232. The high-frequency transmission and reception circuit 204 can transmit and receive a high-frequency signal through the signal wiring W2. The low-frequency transmission circuit 205 of the outdoor unit 2 can transmit a low-frequency signal through the signal wiring W2.

(4) Communication Means of Air Conditioners 121 and 122

(4-1) Communication Using Power Supply Wiring W1

For example, in a case where the outdoor unit 2 and the plurality of indoor units 3 are connected by the power supply wiring W1, the outdoor unit 2 and the indoor unit 3 can perform current loop communication by using the power supply wiring W1. A low frequency signal used in the current loop communication using the current loop CL is sent from the low-frequency transmission and reception circuit 206 of the outdoor unit 2 to the low-frequency transmission and reception circuit 306 of the indoor unit 3, through the power line L1 and the signal line L2. The low-frequency signal is a current signal due to a change in current flowing through the power line L1 and the signal line L2. The low frequency signal transmitted using the current loop CL is used for the system recognition described above, for example.

In communication using the power supply wiring W1, a high-frequency signal is transmitted to the high-frequency transmission and reception circuit 304 of the indoor unit 3 from the high-frequency transmission and reception circuit 204 of the outdoor unit 2, via the band-pass filter 221, the coupling circuit 222, the noise filter 223, the power line L1 and the signal line L2, the noise filter 323, the coupling circuit 322, and the band-pass filter 321. Further, the high-frequency signal is transmitted from the high-frequency transmission and reception circuit 304 of the indoor unit 3 to the high-frequency transmission and reception circuit 204 of the outdoor unit 2, via the band-pass filter 321, the coupling circuit 322, the noise filter 323, the power line L1 and the signal line L2, the noise filter 223, the coupling circuit 222, and the band-pass filter 221. The band-pass filter 221 is connected to the current loop CL via the noise filter 223 and the coupling circuit 222. The noise filter 223 reduces noise of a high-frequency signal received from the wiring of the current loop CL. For transmission and reception of the high-frequency voltage signal, the coupling circuit 322 is a circuit that does not allow passage of a DC component but allows passage of an AC component. The coupling circuit 322 allows passage of a high-frequency signal by, for example, a coupling capacitor. This high-frequency signal is a voltage signal due to a change in voltage generated in the power line L1 and the signal line L2. The high-frequency signal transmitted using the power line L1 and the signal line L2 is used, for example, for the system recognition described above, and communication between the outdoor unit 2 and the indoor unit 3 during normal operation of the air conditioner 121 after the system recognition. Note that the noise filter 223 can be omitted from the configuration of the outdoor unit 2.

Communication in a case of using a set of the power line L1 and the signal line L2 is preferably communication by a communication method that is multichannel communication and power line communication. Examples of such a communication method include, for example, high-speed power line carrier communication. Examples of the high-speed power line carrier system include HD-PLC (registered trademark). The high-frequency transmission and reception circuit 304 is preferably configured to perform determination as to being uncommunicable or difficult to communicate for each frequency band, and not to use a frequency band determined to be uncommunicable or difficult to communicate, as the first frequency band. The frequency band determined to be uncommunicable or difficult to communicate may be stored by the MCU 303, may be stored by the high-frequency transmission and reception circuit 304, and may be stored by a memory (not illustrated) outside the MCU 303 and the high-frequency transmission and reception circuit 304.

(4-2) Communication Using Signal Wiring W2

In the air conditioner 121, for example, in a case where the outdoor unit 2, the plurality of indoor units 3, and the centralized-controller 4 are connected by the signal wiring W2, the outdoor unit 2, the indoor unit 3, and the centralized-controller 4 can communicate using the signal wiring W2. The centralized-controller 4 includes, for example, an MCU, a high-frequency transmission and reception circuit, and a low-frequency reception circuit similar to the outdoor unit 2 or the indoor unit 3, and can perform communication using a high-frequency signal and a low frequency signal. Since the same configuration as the outdoor unit 2 or the indoor unit 3 can be used for an internal configuration for communication of the centralized-controller 4, a description of a configuration for communication of the centralized-controller 4 is omitted here.

A low frequency signal transmitted through the signal wiring W2 is sent from the low-frequency transmission circuit 205 of the outdoor unit 2 to the low-frequency reception circuit 305 of the indoor unit 3, via the low-pass filter 232, the signal wiring W2, and the low-pass filter 332. The low frequency signal is a voltage signal due to a change in voltage generated in the signal wiring W2. The low frequency signal transmitted using the signal wiring W2 is used, for example, for the system recognition described above.

In the communication using the signal wiring W2, a high-frequency signal is transmitted from the high-frequency transmission and reception circuit 204 of the outdoor unit 2 to the high-frequency transmission and reception circuit 304 of the indoor unit 3, via the high-pass filter 231, the signal wiring W2, and the high-pass filter 331. Further, the high-frequency signal is transmitted from the high-frequency transmission and reception circuit 304 of the indoor unit 3 to the high-frequency transmission and reception circuit 204 of the outdoor unit 2, via the high-pass filter 331, the signal wiring W2, and the high-pass filter 231. The high-frequency signal is a voltage signal due to a change in voltage generated in the signal wiring W2. The high-frequency signal transmitted using the signal wiring W2 is used, for example, for the system recognition described above, and communication between the outdoor unit 2 and the indoor unit 3 during normal operation of the air conditioner 121 after the system recognition.

Similarly to transmission and reception of a low frequency signal and a high-frequency signal performed between the outdoor unit 2 and the indoor unit 3, transmission and reception of a low frequency signal and a high-frequency signal can be performed between the outdoor unit 2 and the centralized-controller 4. Further, in this case, the high-frequency signal can be transmitted and received between the centralized-controller 4 and the indoor unit 3. Note that communication between the centralized-controller 4 and the indoor unit 3 using high-frequency signal can be performed by using the high-frequency transmission and reception circuit of the centralized-controller 4 and the high-frequency transmission and reception circuit 304 of the indoor unit 3.

Further, similarly to transmission and reception of a low frequency signal and a high-frequency signal performed between the outdoor unit 2 and the indoor unit 3, transmission and reception of a low frequency signal and a high-frequency signal may be performed between the centralized-controller 4, and the outdoor unit 2 and the indoor unit 3. In such a configuration, for example, a configuration for communication of the centralized-controller can be configured similarly to a configuration for communication of the outdoor unit 2. In this case, the outdoor unit 2 and the indoor unit 3 receive a low frequency signal transmitted by the centralized-controller 4.

Note that, in the air conditioner 122, the centralized-controller 4 and the indoor unit 3 are not directly connected. Therefore, the air conditioner 122 does not perform communication using the signal wiring W2.

(5) Communication Means of Air Conditioner 110

In a case of the multi-split air conditioner 110, the indoor unit 3 is supplied with electric power from the commercial power source 902 other than the outdoor unit 2. The outdoor unit 2 is supplied with electric power from the commercial power source 901 different from the commercial power source 902. In the air conditioner 110, the outdoor unit 2 and the indoor unit 3 are not connected by the power supply wiring W1. Therefore, the multi-split outdoor unit 2 does not have a communication means using current loop communication.

(5-1) Communication Using Signal Wiring W2

Figure 11:
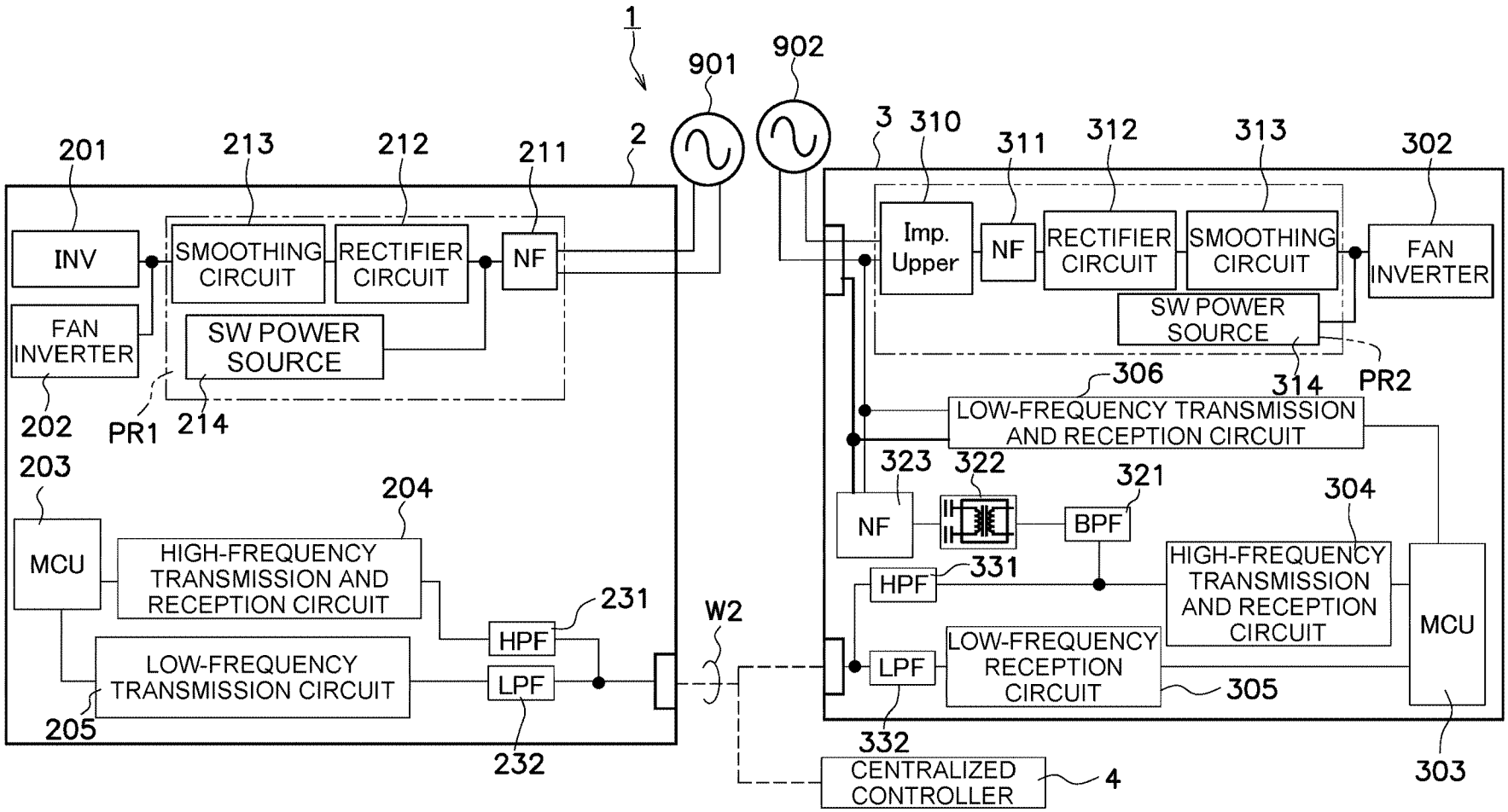
FIG. 11 is a block diagram for explaining a configuration related to communication between an outdoor unit and an indoor unit constituting a multi-split air conditioner.
Figure 12:
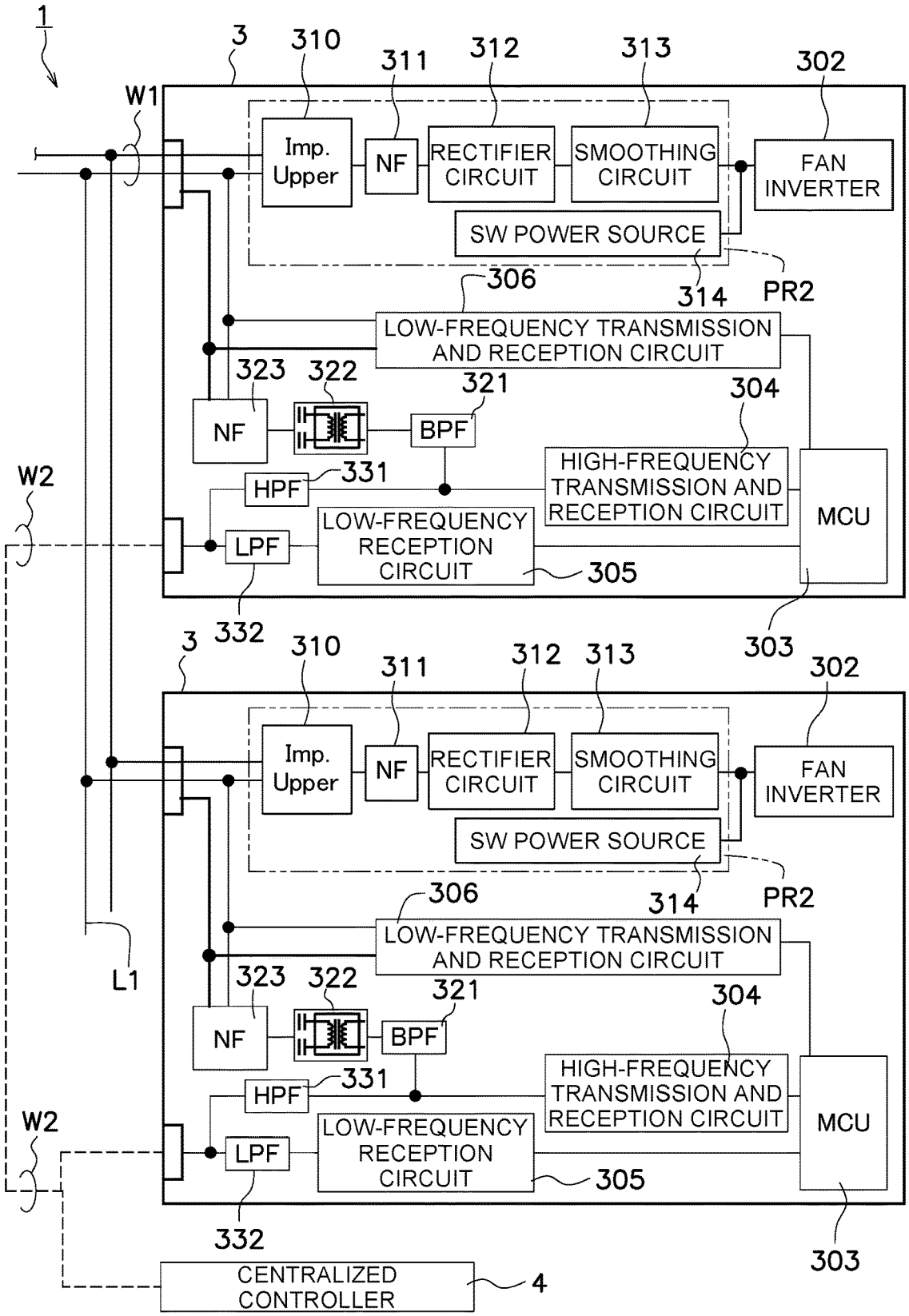
FIG. 12 is a block diagram illustrating an example of connection of a plurality of indoor units in the air conditioner of FIG. 11.

The multi-split air conditioner 110 uses the high-frequency transmission and reception circuit 204 and the low-frequency transmission circuit 205 to communicate with the plurality of indoor units 3 and the centralized-controller 4 via the signal wiring W2. For example, in a case where the outdoor unit 2, the plurality of indoor units 3, and the centralized-controller 4 are connected by the signal wiring W2, the outdoor unit 2, the indoor unit 3, and the centralized-controller 4 can communicate using the signal wiring W2. Since the communication using the signal wiring W2 between the high-frequency transmission and reception circuit 204 and the low-frequency transmission circuit 205 has been described in the above embodiment, a description thereof will be omitted here. Although only one indoor unit 3 is illustrated in FIG. 11, the air conditioner 110 includes a plurality of indoor units 3 connected to each other via a communication line as illustrated in FIG. 12. Since the multi-split air conditioner 110 does not perform communication using the current loop CL, a configuration necessary for the current loop communication is omitted.

(6) Communication Means of Air Conditioners 131 and 132

Connection between the outdoor unit 2, the indoor unit 3, and the centralized-controller 4 of the residential air conditioner 131 is the same as the connection of the air conditioners 121 illustrated in FIG. 9. In addition, connection between the outdoor unit 2 and the indoor unit 3 of the residential air conditioner 132 is the same as the connection of the air conditioner 121 illustrated in FIG. 9 excluding connection using the signal wiring W2.

(7) Modifications (7-1) Modification A

In the above embodiment, the refrigerant used in the vapor compression refrigeration cycle has been described as an example of the medium that carries thermal energy in the air conditioner 1. However, the medium that carries thermal energy is not limited to the refrigerant. Examples of the medium that carries thermal energy in the air conditioner 1 include, for example, air used in a total air heat transport system, and water or a heat medium that is made circulate while managing a liquid temperature. Examples of an air conditioner in the case of water that is made circulate while managing a liquid temperature include, for example, a combination of a fan coil unit and a heat source device. Further, examples of an air conditioner in the case of air used for a total air heat transport system include, for example, a combination of an air handling unit and a blow-out device that blows air sent from the air handling unit into a room.

(7-2) Modification B

The indoor unit 3 according to the above embodiment includes the low-frequency transmission and reception circuit 306, and is configured to be incorporated in the residential air conditioners 131 and 132. However, the indoor unit 3 can be configured to be incorporated in the multi-split air conditioner 110 and the commercial air conditioners 121 and 122, but not to be incorporated in the residential air conditioners 131 and 132. In this case, a low-frequency reception circuit capable of only reception may be used instead of the low-frequency transmission and reception circuit 306 of the indoor unit 3, and a low-frequency transmission circuit may be used as the low-frequency transmission and reception circuit 206 of the outdoor unit 2.

(8) Features (8-1)

The indoor unit 3 according to the above embodiment and modifications can be incorporated in the air conditioners 121 and 122 including the outdoor unit 2. The indoor unit 3 of the air conditioners 121 and 122 includes the power receiving circuit PR2, the low-frequency transmission and reception circuit 306 as a first reception circuit, the high-frequency transmission and reception circuit 304 as a transmission and reception circuit, and the MCU 303 as a inner-controller. The power receiving circuit PR2 can be connected to the outdoor unit 2 by the power supply wiring W1 to receive electric power via the outdoor unit 2, and can also be connected except for the outdoor unit 2 to receive electric power. The power receiving circuit PR2 can be connected to the commercial power source 902 other than the outdoor unit 2 to receive electric power. The low-frequency transmission and reception circuit 306 can receive a current signal transmitted from the outdoor unit 2 by using the current loop CL formed by the power line L1 included in the power supply wiring W1. The high-frequency transmission and reception circuit 304 can transmit and receive a voltage signal for communication using a change in voltage. The MCU 303 selects a communication circuit for a communication state for system recognition, which is a first communication state for recognizing physical connection between with the outdoor unit 2, and a second communication state for performing communication for operation of the air conditioners 121 and 122 between with the outdoor unit 2.

In the air conditioners 121 and 122, the MCU 303 selects the low-frequency transmission and reception circuit 306 that performs communication using the current loop CL, in the communication state for system recognition. In the air conditioners 121 and 122, the MCU 303 selects the high-frequency transmission and reception circuit 304 that performs communication using the wiring of the current loop CL. In a case where the outdoor unit 2 and the power receiving circuit PR2 of the indoor unit 3 are connected by the power supply wiring W1, it is possible to recognize the physical connection between with the outdoor unit 2 by using communication using the current loop CL that is resistant to noise. In a case where the outdoor unit 2 and the power receiving circuit PR2 of the indoor unit 3 are not connected by the power supply wiring W1, the MCU 303 can recognize the physical connection between with the outdoor unit 2 through communication other than current loop communication using the high-frequency transmission and reception circuit 304 by using the signal wiring W2, for example, as in the air conditioner 110.

(8-2)

A frequency used for communication by the high-frequency transmission and reception circuit 304, which is a transmission and reception circuit of the air conditioners 121 and 122, is higher than a frequency used for communication by the low-frequency transmission and reception circuit 306, which is a first reception circuit. This configuration enables a large amount of data to be transmitted and received in a short time in communication for operation of the air conditioners 121 and 122.

(8-3)

The MCU 303, which is a inner-controller of the air conditioners 121 and 131, may receive a current signal by using the current loop CL and receive a voltage signal through the signal wiring W2, as in the case of determining as in steps ST6 and ST10 in FIG. 7. In such a case, the MCU 303 selects use of the low-frequency transmission and reception circuit 306 which is the first reception circuit and the high-frequency transmission and reception circuit 304 which is the transmission and reception circuit, in the communication state for system recognition (an example of the first communication state). Such selection enables system recognition to be performed not only for the outdoor unit 2 and the indoor unit 3 but also for the centralized-controller 4. In the second communication state in which communication for operation of the air conditioners 121 and 131 is performed, the MCU 303 selects use of the high-frequency transmission and reception circuit 304 instead of the low-frequency transmission and reception circuit 306. In a case where the outdoor unit 2 and the power receiving circuit PR2 of the indoor unit 3 are connected by the power supply wiring W1, the indoor unit 3 can reliably recognize the physical connection between with the outdoor unit 2 by using the power supply wiring W1 having a low impedance and by using communication using the current loop CL that is resistant to noise.

(8-4)

In the communication state for system recognition, a frequency of a current signal received by the low-frequency transmission and reception circuit 306 may be set to be the same as a frequency of the commercial power source 901 applied to the power supply wiring W1. Such a setting makes it possible to use a power source frequency supplied from the commercial power source 901 to a transmission source of a current signal of the outdoor unit 2, and the configuration of the outdoor unit 2 connected to the indoor unit 3 can be easily simplified.

(8-5)

The high-frequency transmission and reception circuit 304 of the indoor unit 3 preferably transmits and receives a voltage signal by a communication method that is power line communication and multi-channel communication. Examples of such a communication method include, for example, high-speed power line carrier communication. Examples of the high-speed power line carrier system include HD-PLC (registered trademark). By using the high-speed power line carrier communication, data can be transmitted and received at high speed without increasing communication wiring between the outdoor unit 2 and the indoor unit 3.

(8-6)

The high-frequency transmission and reception circuit 304, which is a transmission and reception circuit of the indoor unit 3 incorporated in the air conditioners 110, 121, and 131, performs transmission and reception using the signal wiring W2, which is a signal line other than the power supply wiring W1. Even in a case where the power receiving circuit PR2 is connected except for the outdoor unit 2, the indoor unit 3 configured as described above can perform communication for operation of the air conditioners 110, 121, and 131 between with the outdoor unit 2, by using the signal wiring W2 other than the power supply wiring W1.

(8-7)

The indoor unit 3 incorporated in the air conditioner 110 includes the low-frequency reception circuit 305 which is a second reception circuit that receives a low-frequency voltage signal for communication using a change in voltage, by using the signal wiring W2 other than the power supply wiring W1. The high-frequency transmission and reception circuit 304 of the indoor unit 3 of the air conditioner 110 transmits and receives a high-frequency voltage signal having a frequency higher than that of the low-frequency voltage signal. When the MCU 303 of the indoor unit 3 of the air conditioner 110 has not received a current signal but has received a low-frequency voltage signal, the MCU 303 uses the low-frequency reception circuit 305 and the high-frequency transmission and reception circuit 304 without using the low-frequency transmission and reception circuit 306 which is the first reception circuit, in the communication state for system recognition which is the first communication state. In a communication state for operation of the air conditioner 110, which is the second communication state, the MCU 303 uses the high-frequency transmission and reception circuit 304 without using the low-frequency transmission and reception circuit 306 and the low-frequency reception circuit 305. As described above, the indoor unit 3 can be applied to the multi-split air conditioner 110.

(8-8)

In the indoor unit 3 incorporated in the residential air conditioners 131 and 132, the low-frequency transmission and reception circuit 306 functions as a current loop communication circuit capable of transmitting and receiving a current signal to and from the outdoor unit 2 by using the current loop CL. When the physical connection between with the outdoor unit 2 cannot be recognized in the communication state (first communication state) for the system recognition, the MCU 303, which is the inner-controller of the air conditioners 131 and 132, performs transmission and reception between with the outdoor unit 2 by using the low-frequency transmission and reception circuit 306 (current loop communication circuit) without using the low-frequency reception circuit 305 and the high-frequency transmission and reception circuit 304, in the communication state (second communication state) for operation of the air conditioners 131 and 132. In a case of connection in which one indoor unit 3 is always determined for one outdoor unit 2, the indoor unit 3 can also cope with a form such as the residential air conditioners 131 and 132 that communicate with the outdoor unit 2 by using only the current loop CL.

Although the embodiment of the present disclosure have been described above, it will be understood that various changes in form and details can be made without departing from the spirit and scope of the present disclosure described in the claims.

REFERENCE SIGNS LIST

2, 2*a*, 2*b*: outdoor unit
3, 3*a* to 3*f*: indoor unit
110, 121, 122, 131, 132: air conditioner
303: MCU (example of inner controller)
304: high-frequency transmission and reception circuit (example of transmission and reception circuit)
305: low-frequency reception circuit (example of second reception circuit)
306: low-frequency transmission and reception circuit (example of first reception circuit)
PR2: power receiving circuit

CITATION LIST

Patent Literature

Patent Literature 1: JP 2013-137119 A

The invention claimed is:

1. An indoor unit included in an air conditioner including an outdoor unit, the indoor unit comprising:

a power receiving circuit configured to be connectable to the outdoor unit by power supply wiring to receive electric power via the outdoor unit, and configured to be connectable to a power source other than the outdoor unit to receive electric power;

a first reception circuit configured to receive a current signal transmitted from the outdoor unit by using a current loop configured by a power line included in the power supply wiring;

a transmission and reception circuit configured to transmit and receive a voltage signal for communication using a change in voltage; and an inner-controller that selects use of the transmission and reception circuit and the first reception circuit in a first communication state and a second communication state, wherein the first communication state is a state in which physical connection between with the outdoor unit is recognized and the second communication state is a state in which communication for operation of the air conditioner is performed with the outdoor unit.

2. The indoor unit according to claim 1, wherein a frequency used by the transmission and reception circuit for communication is higher than a frequency used by the first reception circuit for communication.

3. The indoor unit according to claim 2, wherein when the inner-controller has received the current signal and has received the voltage signal, the inner-controller uses the first reception circuit and the transmission and reception circuit in the first communication state, and uses the transmission and reception circuit without using the first reception circuit in the second communication state.

4. The indoor unit according to claim 2, wherein the transmission and reception circuit transmits and receives the voltage signal by a communication method that is power line communication and multi-channel communication.

5. The indoor unit according to claim 2, wherein the transmission and reception circuit can perform transmission and reception by using a signal line other than the power supply wiring.

6. The indoor unit according to claim 1, wherein when the inner-controller has received the current signal and has received the voltage signal, the inner-controller uses the first reception circuit and the transmission and reception circuit in the first communication state, and uses the transmission and reception circuit without using the first reception circuit in the second communication state.

7. The indoor unit according to claim 6, wherein in the first communication state, in the inner-controller, a frequency of the current signal received by the first reception circuit is identical to a frequency of a power source applied to the power supply wiring.

8. The indoor unit according to claim 7, wherein the transmission and reception circuit transmits and receives the voltage signal by a communication method that is power line communication and multi-channel communication.

9. The indoor unit according to claim 6, wherein the transmission and reception circuit transmits and receives the voltage signal by a communication method that is power line communication and multi-channel communication.

10. The indoor unit according to claim 1, wherein the transmission and reception circuit transmits and receives the voltage signal by a communication method that is power line communication and multi-channel communication.

11. The indoor unit according to claim 1, wherein the transmission and reception circuit is configured to perform transmission and reception by using a signal line other than the power supply wiring.

12. The indoor unit according to claim 11, comprising:

a second reception circuit that receives a low-frequency voltage signal for communication using a change in voltage, by using the signal line other than the power supply wiring, wherein the transmission and reception circuit transmits and receives a high-frequency voltage signal having a frequency higher than a frequency of the low-frequency voltage signal, and when the inner-controller has not received the current signal and has received the low-frequency voltage signal, the inner-controller uses the second reception circuit and the transmission and reception circuit without using the first reception circuit in the first communication state, and uses the transmission and reception circuit without using the first reception circuit and the second reception circuit in the second communication state.

13. The indoor unit according to claim 12, wherein the first reception circuit is a current loop communication circuit that can transmit and receive the current signal to and from the outdoor unit by using the current loop, and when the inner-controller cannot recognize physical connection between with the outdoor unit in the first communication state, the inner-controller performs transmission and reception to and from the outdoor unit by using the current loop communication circuit without using the second reception circuit and the transmission and reception circuit in the second communication state.

* * * * *